US005982403A

United States Patent [19]

Inagaki

[11] Patent Number: 5,982,403

[45] Date of Patent: Nov. 9, 1999

[54] POTENTIAL ESTIMATING APPARATUS USING A PLURALITY OF NEURAL NETWORKS FOR CARRYING OUT AN ELECTROGRAPHIC PROCESS

[75] Inventor: Tatsuya Inagaki, Tokyo, Japan

[73] Assignee: Ricoh Company, Ltd., Tokyo, Japan

[21] Appl. No.: 08/895,199

[22] Filed: Jul. 16, 1997

Related U.S. Application Data

[63] Continuation of application No. 08/729,798, Oct. 8, 1996, Pat. No. 5,699,096, which is a continuation of application No. 08/157,926, Nov. 24, 1993.

[30] Foreign Application Priority Data

Nov. 30, 1992 [JP] Japan ..... 4-320934

[51] Int. Cl.[6] ..... B41J 2/385

[52] U.S. Cl. ..... 347/135; 347/140

[58] Field of Search ..... 347/135, 140, 347/253, 133; 395/25, 77; 600/408; 701/59; 704/202, 232, 259

[56] References Cited

U.S. PATENT DOCUMENTS 4,689,694 8/1987 Yoshida .
5,204,718 4/1993 Morita .
5,216,463 6/1993 Morita .
5,699,096 12/1997 Inagaki ..... 347/133

FOREIGN PATENT DOCUMENTS 63-151973 6/1988 Japan .
310269 1/1991 Japan .

*Primary Examiner*—Benjamin R. Fuller
*Assistant Examiner*—Raquel Yvette Gordon
*Attorney, Agent, or Firm*—Cooper & Dunham LLP

[57] ABSTRACT

A potential estimation apparatus estimates a potential of a photosensitive body of an image forming apparatus that carries out an electro-photography process using the photosensitive body. The potential estimation apparatus includes a sensor group for sensing and outputting data related to information which affects the electro-photography process, a storage unit for at least storing the data output from the sensor group and information related to charge of the photosensitive body, and an estimation circuit including a neural network for estimating a charged portion potential of the photosensitive body based on a charge retentivity of the photosensitive body learned by the neural network. The neural network in a learning mode receives at least one of the data output from the sensor group and time-sequentially sampled, and parameters which affect the charge retentivity of the photosensitive body as an input, and receives as a teaching value a charged portion potential which is obtained in advance with respect to at least an amount of charge and the charge retentivity of the photosensitive body.

36 Claims, 19 Drawing Sheets

CHARGE RETENTIVITY ( VG - VD CHARACTERISTIC )

POTENTIAL ESTIMATING APPARATUS USING A PLURALITY OF NEURAL NETWORKS FOR CARRYING OUT AN ELECTROGRAPHIC PROCESS

This is a continuation of application Ser. No. 08/729,798 filed Oct. 8, 1996, now U.S. Pat. No. 5,699,096, which in turn is a continuation of application Ser. No. 08/157,926 filed Nov. 24, 1993.

BACKGROUND OF THE INVENTION

The present invention generally relates to potential estimation apparatuses, and more particularly to a potential estimation apparatus which is suited for estimating a potential of an electro-photographic photosensitive body of an image forming apparatus that carries out an electrophotography process. In other words, the potential estimation apparatus is suited for use in a copying machine, a printer, a facsimile machine and the like which carry out image formation such as copying and printing by the electrophotography process.

Conventionally, various methods have been proposed to control the latent image in the electro-photography process. For example, there is a first method which measures the surface potential of a photosensitive drum using a surface electrometer, and looks up values for control input such as the charger voltage, the charging grid voltage and the exposure lamp voltage from a table using each measured value. This table prestores values (voltages in this case) for the control input which are obtained in advance for various measured values, and the latent image is controlled based on the values read from the table. On the other hand, there is a second method which feeds back the state of the image forming apparatus via sensors or the like while changing the control input, so as to find optimum control input by a PID control, for example.

However, according to the first method which looks up the table, there was a problem in that it is difficult to correctly grasp the characteristics of the photosensitive drum. In addition, according to the second method which uses the feedback control, the feedback loop must be repeated a plurality of times, that is, the charging and exposing processes are repeated, until an ideal controlled state is reached. For this reason, it takes time until the ideal controlled state is reached according to this second method, and there were problems in that the performance of the image forming apparatus itself deteriorates. In other words, the image forming speed per unit time deteriorates according to the second method, and it takes a long time until a first copy or print is formed by the image formation.

On the other hand, there is a proposed method which carries out a control to constantly form an image of a high quality by correcting the deterioration of the sensitivity based on the number of copies or prints made and the total rotational time of the photosensitive drum. However, this proposed method had a problem in that it is impossible to correct the deterioration of the potential characteristic which occurs on a short term basis due to the repetitive charging, exposure and discharging of the photosensitive drum.

SUMMARY OF THE INVENTION

Accordingly, it is a general object of the present invention to provide a novel and useful potential estimation apparatus in which the problems described above are eliminated.

Another and more specific object of the present invention is to provide a potential estimation apparatus which estimates a potential of a photosensitive body of an image forming apparatus that carries out an electrophotography process using the photosensitive body, comprising sensor means for sensing and outputting data related to information which affects the electrophotography process, storage means for at least storing the data output from the sensor means and information related to charge of the photosensitive body, and estimation means, including a first neural network coupled to the sensor means and the storage means, for estimating a charged potential of the photosensitive body based on a charge retentivity of the photosensitive body learned by the first neural network, where the first neural network in a learning mode receives at least one of the data output from the sensor means and time-sequentially sampled, and parameters which affect the charge retentivity of the photosensitive body as an input, and receives as a teaching value a charged potential which is obtained in advance with respect to at least an amount of charge and the charge retentivity of the photosensitive body. According to the potential estimation apparatus of the present invention, it is possible to estimate the surface potential of the photosensitive body with a high accuracy because the charged potential for the next print is estimated from the charge retentivity which is obtained in advance by the learning of the neural network. In addition, it is possible to carry out a control so that the final image has a satisfactory quality by detecting both the deterioration of the sensitivity of the photosensitive body on a long term basis and the deterioration of the sensitivity of the photosensitive body on a short term basis.

Still another object of the present invention is to provide the potential estimation apparatus described above, wherein the storage means further stores information related to an amount of charge and an amount of exposure of the photosensitive body, and the first neural network in the learning mode receives as the teaching value a charged potential which is obtained in advance with respect to also the amount of exposure of the photosensitive body. According to the potential estimation apparatus of the present invention, it is possible to estimate the charged potential for the next print by taking into consideration the variation factors related to the exposure, because the neural network learns by taking into account the parameters such as the control input of the exposure and the exposing laser or lamp voltage.

A further object of the present invention is to provide he potential estimation apparatus described first above, wherein the storage means further stores information related to an amount of charge and an amount of exposure of the photosensitive body, the estimation means further includes a second neural network coupled to the sensor means and the storage means, for estimating an exposed portion potential of an exposed portion of the photosensitive body based on an exposure sensitivity of the photosensitive body learned by the second neural network, and the second neural network in a learning mode receives at least one of the data output from the sensor means and time-sequentially sampled and parameters which affect the exposure sensitivity of the photosensitive body, and an output of the first neural network as inputs, and receives as a teaching value an exposed portion potential which is obtained in advance with respect to at least the exposure sensitivity, the amount of charge, an amount of exposure and the charged potential of the photosensitive body. According to the potential estimation apparatus of the present invention, it is possible to accurately obtain the exposed portion potential because the output of the first neural network is used. In addition, it is possible to simplify the construction of the apparatus by using the two neural networks.

Another object of the present invention is to provide the potential estimation apparatus described second above, wherein the estimation means further includes a second neural network coupled to the sensor means and the storage means, for estimating an exposed portion potential of an exposed portion of the photosensitive body based on an exposure sensitivity of the photosensitive body learned by the second neural network, and the second neural network in a learning mode receives at least one of the data output from the sensor means and time-sequentially sampled and parameters which affect the exposure sensitivity of the photosensitive body, and an output of the first neural network as inputs, and receives as a teaching value an exposed portion potential which is obtained in advance with respect to at least the exposure sensitivity, the amount of charge, an amount of exposure and the charged potential of the photosensitive body. According to the potential estimation apparatus of the present invention, it is possible to obtain the exposed portion potential with a high accuracy because the output of the first neural network is used. Further, it is possible to simplify the construction of the apparatus by using the two neural networks.

Still another object of the present invention is to provide a potential estimation apparatus which estimates a potential of a photosensitive body of an image forming apparatus that carries out an electrophotography process using the photosensitive body, comprising sensor means for sensing and outputting data related to information which affects the electrophotography process, storage means for at least storing the data output from the sensor means, and estimation means, including a first neural network coupled to the sensor means and the storage means, for estimating a charged potential of the photosensitive body based on a charge retentivity of the photosensitive body learned by the first neural network, where the first neural network in a learning mode receives at least one of the data output from the sensor means and time-sequentially sampled, and parameters which affect the charge retentivity of the photosensitive body as an input, and receives as a teaching value a charged potential which is obtained in advance with respect to a charged potential and an amount of charge of a pattern which is formed on the photosensitive body by charging with a predetermined amount of charge for the purpose of measuring the potential. According to the potential estimation apparatus of the present invention, it is possible to estimate the surface potential of the photosensitive body with a sufficiently high accuracy even if the inputs are reduced compared to the first described potential estimation apparatus, because the charged potential for the next print is estimated from the charge retentivity which is learned by the neural network and the photosensitive body is charged with a predetermined amount of charge. Hence, the construction of the potential estimation apparatus becomes more simple compared to that of the first described potential estimation apparatus, and it is possible to carry out a control so that the final image has a satisfactory quality by detecting both the deterioration of the sensitivity of the photosensitive body on a long term basis and the deterioration of the sensitivity of the photosensitive body on a short term basis.

A further object of the present invention is to provide the potential estimation apparatus described fifth above, wherein the first neural network receives as a teaching value a charged potential which is obtained in advance with respect to the charged potential, the amount of charge and an amount of exposure of a pattern which is formed on the photosensitive body by charging with the predetermined amount of charge and exposing with a predetermined amount of exposure for the purpose of measuring the potential. According to the potential estimation apparatus of the present invention, it is possible to estimate the charged potential for the next print by taking into consideration the variation factors related to the exposure, because the neural network learns by taking into account the parameters such as the control input of the exposure and the exposing laser or lamp voltage.

Another object of the present invention is to provide the potential estimation apparatus described fifth above, wherein the estimation means further includes a second neural network coupled to the sensor means and the storage means, for estimating an exposed portion potential of an exposed portion of the photosensitive body based on an exposure sensitivity of the photosensitive body learned by the second neural network, and the second neural network in a learning mode receives at least one of the data output from the sensor means and time-sequentially sampled and parameters which affect the exposure sensitivity of the photosensitive body, and an output of the first neural network as inputs, and receives as a teaching value an exposed portion potential which is obtained in advance with respect to the exposed portion potential, the charged potential, the amount of charge and the amount of exposure of a pattern which is formed on the photosensitive body by charging with the predetermined amount of charge and exposing with a predetermined amount of exposure for the purpose of measuring the potential. According to the potential estimation apparatus of the present invention, it is possible to obtain the exposed portion potential with a high accuracy by use of the output of the first neural network, and the construction of the apparatus can be simplified by the use of two neural networks. Further, since the photosensitive body is charged with a predetermined amount of charge and exposed with a predetermined amount of exposure, it is possible to simplify the construction of the apparatus compared to the third described potential estimation apparatus.

Still another object of the present invention is to provide the potential estimation apparatus described sixth above, wherein the estimation means further includes a second neural network coupled to the sensor means and the storage means, for estimating an exposed portion potential of an exposed portion of the photosensitive body based on an exposure sensitivity of the photosensitive body learned by the second neural network, and the second neural network in a learning mode receives at least one of the data output from the sensor means and time-sequentially sampled and parameters which affect the exposure sensitivity of the photosensitive body, and an output of the first neural network as inputs, and receives as a teaching value an exposed portion potential which is obtained in advance with respect to the exposed portion potential, the charged potential, the amount of charge and the amount of exposure of a pattern which is formed on the photosensitive body by charging with the predetermined amount of charge and exposing with a predetermined amount of exposure for the purpose of measuring the potential. According to the potential estimation apparatus of the present invention, it is possible to accurately obtain the exposed portion potential by taking into consideration the variation related to the amount of exposure, because the output of the first neural network is used. Further, the construction of the apparatus can be simplified since two neural networks are used. Moreover, it is possible to simplify the construction of the apparatus compared to the fourth described potential estimation apparatus because the photosensitive body is charged with a predetermined amount of charge and exposed with a predetermined amount of exposure.

A further object of the present invention is to provide a potential estimation apparatus which estimates a potential of a photosensitive body of an image forming apparatus that carries out an electro-photography process using the photosensitive body, comprising sensor means for sensing and outputting data related to information which affects the electro-photography process, storage means for at least storing the data output from the sensor means and information related to an amount of charge and an amount of exposure of the photosensitive body, and estimation means, including a neural network coupled to the sensor means and the storage means, for estimating an exposed portion potential of an exposed portion of the photosensitive body based on an exposure sensitivity of the photosensitive body learned by the neural network, where the neural network in a learning mode receives at least one of the data output from the sensor means and time-sequentially sampled, and parameters which affect the exposure sensitivity of the photosensitive body as an input, and receives as a teaching value an exposed portion potential which is obtained in advance with respect to at least the exposure sensitivity, the amount of charge and the amount of exposure of the photosensitive body. According to the potential estimation apparatus of the present invention, it is possible to estimate the charged potential for the next print by taking into consideration the variation factors related to the exposure, because the neural network learns by taking into account the parameters such as the control input of the exposure and the exposing laser or lamp voltage.

Another object of the present invention is to provide a potential estimation apparatus which estimates a potential of a photosensitive body of an image forming apparatus that carries out an electro-photography process using the photosensitive body, comprising sensor means for sensing and outputting data related to information which affects the electro-photography process, storage means for at least storing the data output from the sensor means, and estimation means, including a neural network coupled to the sensor means and the storage means, for estimating an exposed portion potential of an exposed portion of the photosensitive body based on an exposure sensitivity of the photosensitive body learned by the neural network, where the neural network in a learning mode receives at least one of the data output from the sensor means and time-sequentially sampled, and parameters which affect the exposure sensitivity of the photosensitive body as an input, and receives as a teaching value an exposed portion potential which is obtained in advance with respect to at least the exposed portion potential, the amount of charge and the amount of exposure of a pattern which is formed on the photosensitive body by charging with the predetermined amount of charge and exposing with a predetermined amount of exposure for the purpose of measuring the potential. According to the potential estimation apparatus of the present invention, it is possible to estimate the charged potential for the next print by taking into consideration the variation factors related to the exposure because the neural network learns by taking into account the parameters such as the control input of the exposure and the exposing laser or lamp voltage.

Still another object of the present invention is to provide a potential estimation apparatus which estimates a potential of a photosensitive body of an image forming apparatus that carries out an electrophotography process using the photosensitive body, comprising sensor means for sensing and outputting data related to information which affects the electrophotography process, storage means for at least storing the data output from the sensor means and information related to an amount of charge and an amount of exposure of the photosensitive body, and estimation means, including a neural network coupled to the sensor means and the storage means, for estimating a potential of a latent image portion of the photosensitive body based on a charge retentivity and an exposure sensitivity of the photosensitive body learned by the neural network, where the neural network in a learning mode receives at least one of the data output from the sensor means and time-sequentially sampled, and parameters which affect the charge retentivity and the exposure sensitivity of the photosensitive body as an input, and receives as a teaching value a latent image potential which is obtained in advance with respect to at least the exposure sensitivity, the amount of charge, the amount of exposure and the charged potential of the photosensitive body. According to the potential estimation apparatus of the present invention, it is possible to estimate the latent image potential of the photosensitive body with a high accuracy because the latent image potential for the next print is estimated from the charge retentivity and the exposure sensitivity which are learned by the neural network. Further, it is possible to carry out a control so that the final image has a satisfactory quality by detecting both the deterioration of the sensitivity of the photosensitive body on a long term basis and the deterioration of the sensitivity of the photosensitive body on a short term basis.

A further object of the present invention is to provide a potential estimation apparatus which estimates a potential of a photosensitive body of an image forming apparatus that carries out an electro-photography process using the photosensitive body, comprising sensor means for sensing and outputting data related to information which affects the electro-photography process, storage means for at least storing the data output from the sensor means, and estimation means, including a neural network coupled to the sensor means and the storage means, for estimating a potential of a latent image portion of the photosensitive body based on a charge retentivity and an exposure sensitivity of the photosensitive body learned by the neural network, wherein the neural network in a learning mode receives at least one of the data output from the sensor means and time-sequentially sampled, and parameters which affect the charge retentivity and the exposure sensitivity of the photosensitive body as an input, and receives as a teaching value a latent image potential which is obtained in advance with respect to at least an exposed portion potential, an amount of charge and an amount of exposure of a pattern which is formed on the photosensitive body by charging with the predetermined amount of charge and exposing with a predetermined amount of exposure for the purpose of measuring the potential. According to the potential estimation apparatus of the present invention, it is possible to estimate the latent image potential of the photosensitive body with a high accuracy because the latent image potential for the next print is estimated from the charge retentivity and the exposure sensitivity which are learned by the neural network. In addition, it is possible to carry out a control so that the final image has a satisfactory quality by detecting both the deterioration of the sensitivity of the photosensitive body on a long term basis and the deterioration of the sensitivity of the photosensitive body on a short term basis. Furthermore, it is possible to simplify the construction of the apparatus compared to the eleventh described potential estimation apparatus since the photosensitive body is charged with a predetermined amount of charge and exposed with a predetermined amount of exposure.

Other objects and further features of the present invention will be apparent from the following detailed description when read in conjunction with the accompanying drawings.

DESCRIPTION OF THE PREFERRED EMBODIMENTS

Figure 1:
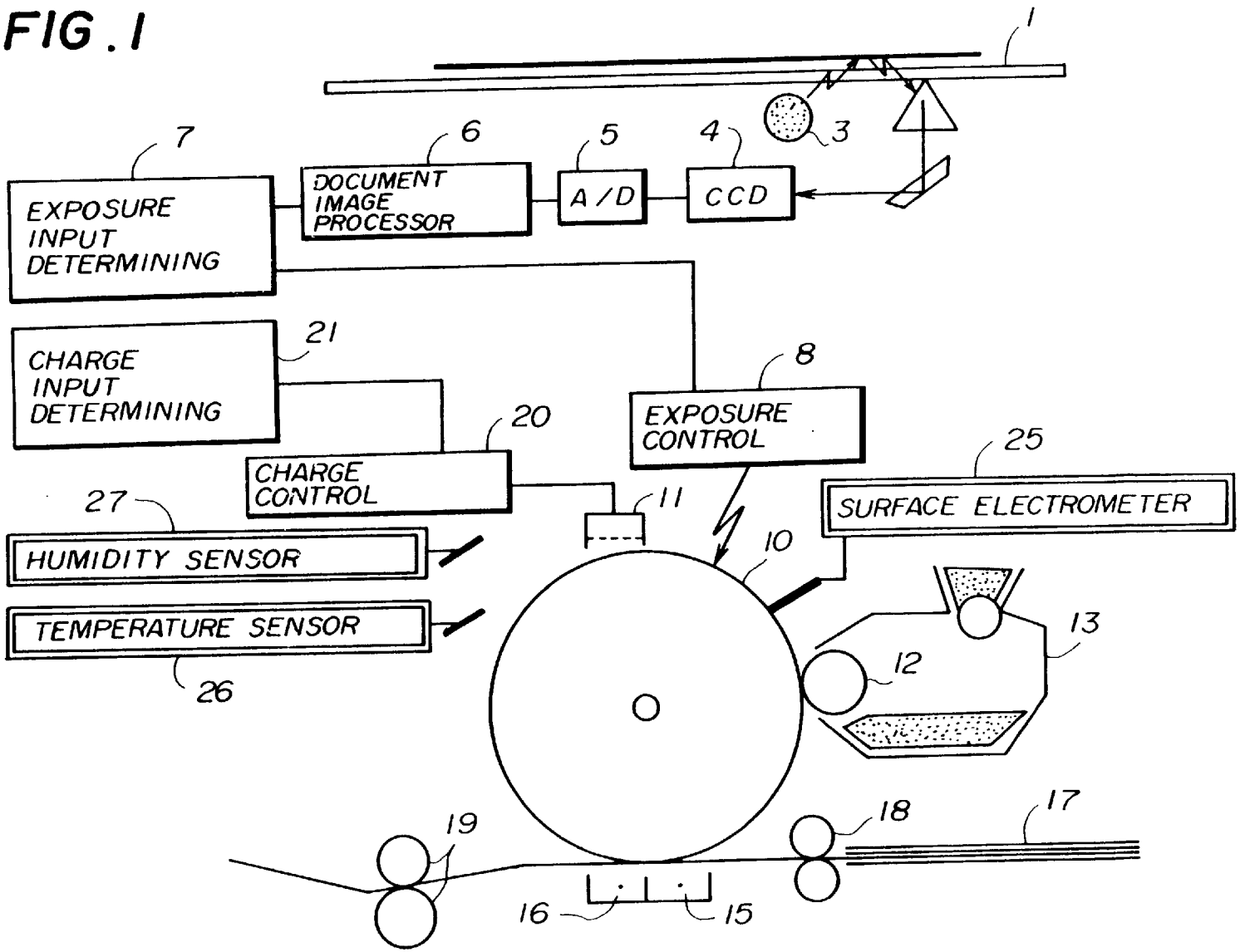
FIG. 1 is a diagram showing an essential part of a copying machine applied with a potential estimation apparatus according to the present invention.

FIG. 1 shows an essential part of a copying machine which is applied with a potential estimation apparatus according to the present invention.

In the copying machine shown in FIG. 1, a lamp 3 irradiates a document 2 which is placed on a document setting base 1. The reflected light from the document 2 is read by a charged coupled device (CCD) 4 which is used as a reading means, and a read image signal is converted into a digital signal by an analog-to-digital (A/D) converter 5. The digital signal is subjected to a predetermined image processing in a document image processor 6. An exposure input determining unit 7 determines the operation related to the exposure based on the processed signal from the document image processor 6. An output of the exposure input determining unit 7 is supplied to an exposure controller 8 which includes a semiconductor laser and the like, and the exposure is made under the control of this exposure controller 8. As a result, an electrostatic latent image is formed on a photosensitive drum 10.

A charger 11 for charging the photosensitive drum 10 by corona discharge, a developing unit 13 including a developing roller 12 for applying toner on the electrostatic latent image so as to visualize the image, a transfer unit 15 for transferring the toner image onto a transfer sheet 14, a separator 16 for separating the transfer sheet 14 from the photosensitive drum 10, a transport roller 18 for transporting the transfer sheet 14 from a paper supply unit 17 to the transfer unit 15, and a fixing roller 19 for fixing the toner image on the transfer sheet 14 which is separated from the photosensitive drum 10 are respectively provided around the photosensitive drum 10. In addition, a charge controller 20 is coupled to the charger 11 to control the charge, and a charge input determining unit 21 for determining the operation related to the charging is coupled to the charge controller 20.

Various sensors are provided in the copying machine to detect environmental information thereof. A surface electrometer 25 detects the potential of the photosensitive drum 10 which is charged by the charger 11. In addition, a temperature sensor 26 and a humidity sensor 27 respectively detect the temperature and humidity within the copying machine. Such sensors are indicated by framed boxes in FIG. 1.

Figure 2:
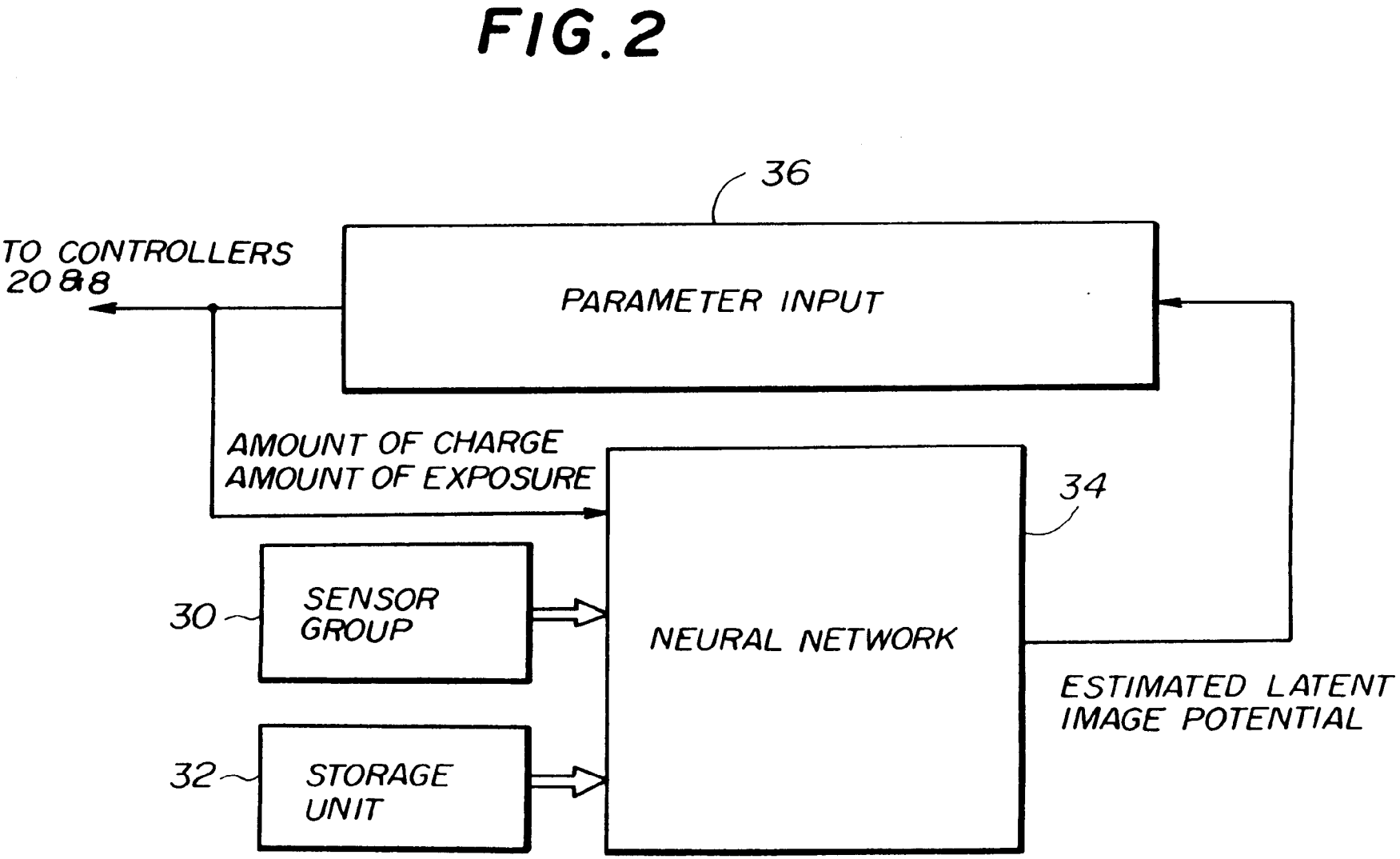
FIG. 2 is a system block diagram showing an essential part of the copying machine shown in FIG. 1.

FIG. 2 shows the construction of the exposure input determining unit 7 and the charge input determining unit 21 shown in FIG. 1 in more detail. The exposure input determining unit 7 and the charge input determining unit 21 includes a sensor group 30, a storage unit 32, a neural network 34, and a parameter input unit 36 which are connected as shown in FIG. 2. The sensor group 30 includes the surface electrometer 25, the temperature sensor 26, the humidity sensor 27 and the like shown in FIG. 1. The storage unit 32 stores information related to the exposure and/or charge of the photosensitive drum 10 and output data of the sensor group 30.

The detected temperature from the temperature sensor 26, the detected humidity from the humidity sensor 27, the detected potential from the surface electrometer 25, and the information related to the charge and exposure of the photosensitive drum 10 and stored in the storage unit 32 are input to the neural network 34. An output of the neural network 34, that is, an estimated potential, is input to the parameter input unit 36. The parameter input unit 36 controls the parameters such as the amount of exposure and the amount of charge so that the estimated potential is adjusted to the ideal potential, and supplies the parameters to the charge controller 20 and the exposure controller 8 shown in FIG. 1.

Next, a description will be given of the control elements related to the charged portion potential (hereinafter also referred to as a charged potential) and the potential of the exposed portion which must be controlled in order to obtain an image having a high quality by the electrophotography process of the copying machine shown in FIG. 1.

Figure 3:
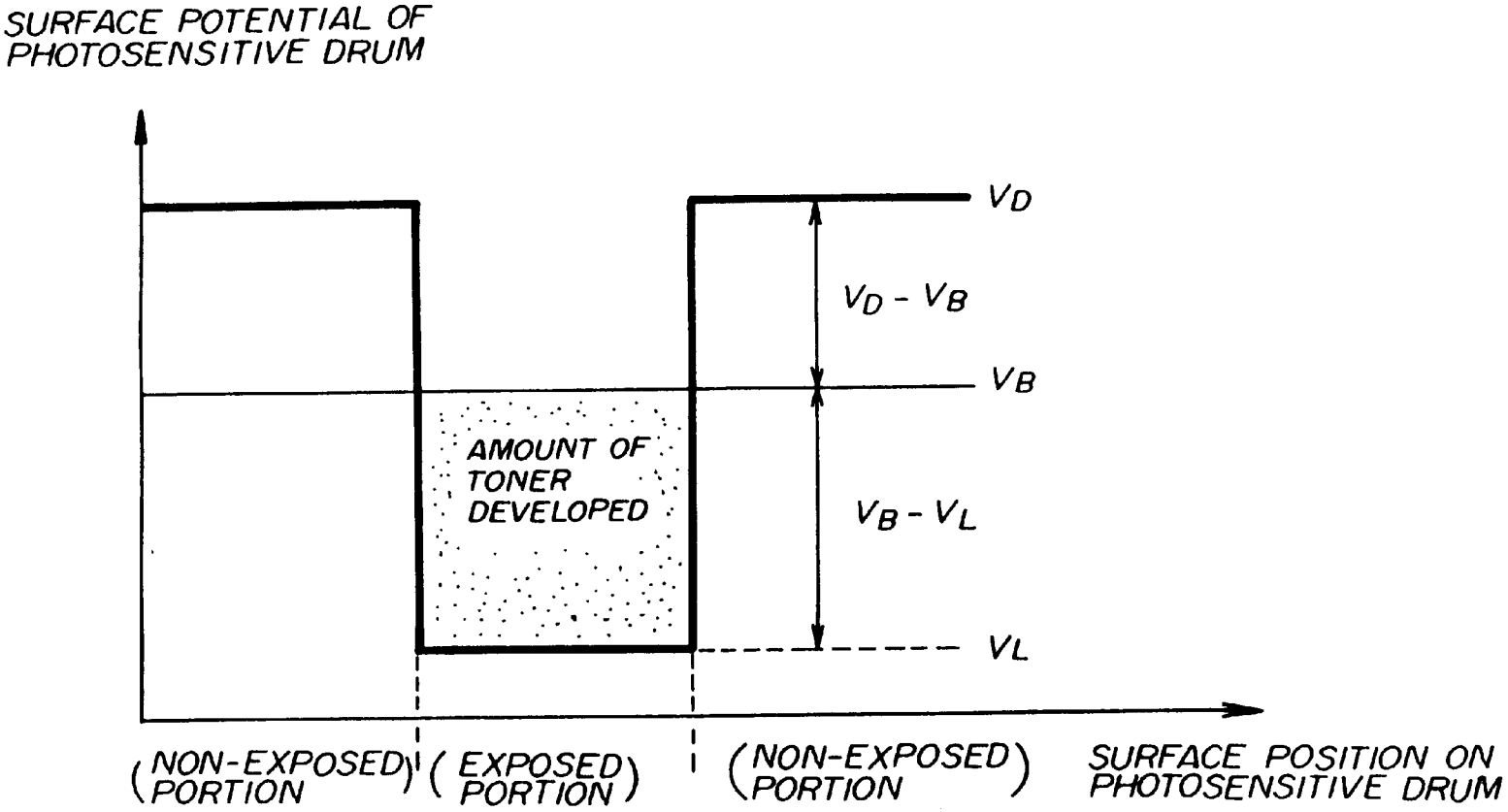
FIG. 3 is a diagram for explaining negative-positive developing techniques.

FIG. 3 shows the relationship of the surface position and the surface potential of the photosensitive drum 10 for the so-called negative-positive developing technique. First, the photosensitive drum 10 is charged to a charged potential VD by the charger 11, and a portion which becomes the image is then exposed to an exposed portion potential VL. A potential difference VB−VL between a developing bias potential VB and the exposed portion potential VL is called a developing potential. An amount of toner proportional to this potential difference (or developing potential) VB−VL is adhered on the photosensitive drum 10 by the developing unit 13, and the toner image is transferred onto the transfer sheet 14 by the transfer unit 15 thereby completing the developing process. In addition, a potential difference VD−VB between the charged potential VD and the developing bias potential VB is called a surface fouling margin, and the surface fouling and the adherence of the developing agent occur if this potential difference (or surface fouling margin) VD−VB is not controlled within an appropriate range. For example, the surface fouling more easily occurs if the surface fouling margin becomes small, and the adherence of the developing agent occurs if the surface fouling margin becomes large. Hence, the charged potential VD, the exposed portion potential VL and the developing bias potential VB must be controlled with a high accuracy in order to obtain an image having a high quality. The above described matters for the negative-positive developing technique also apply similarly to the so-called positive-positive developing technique.

Figure 4:
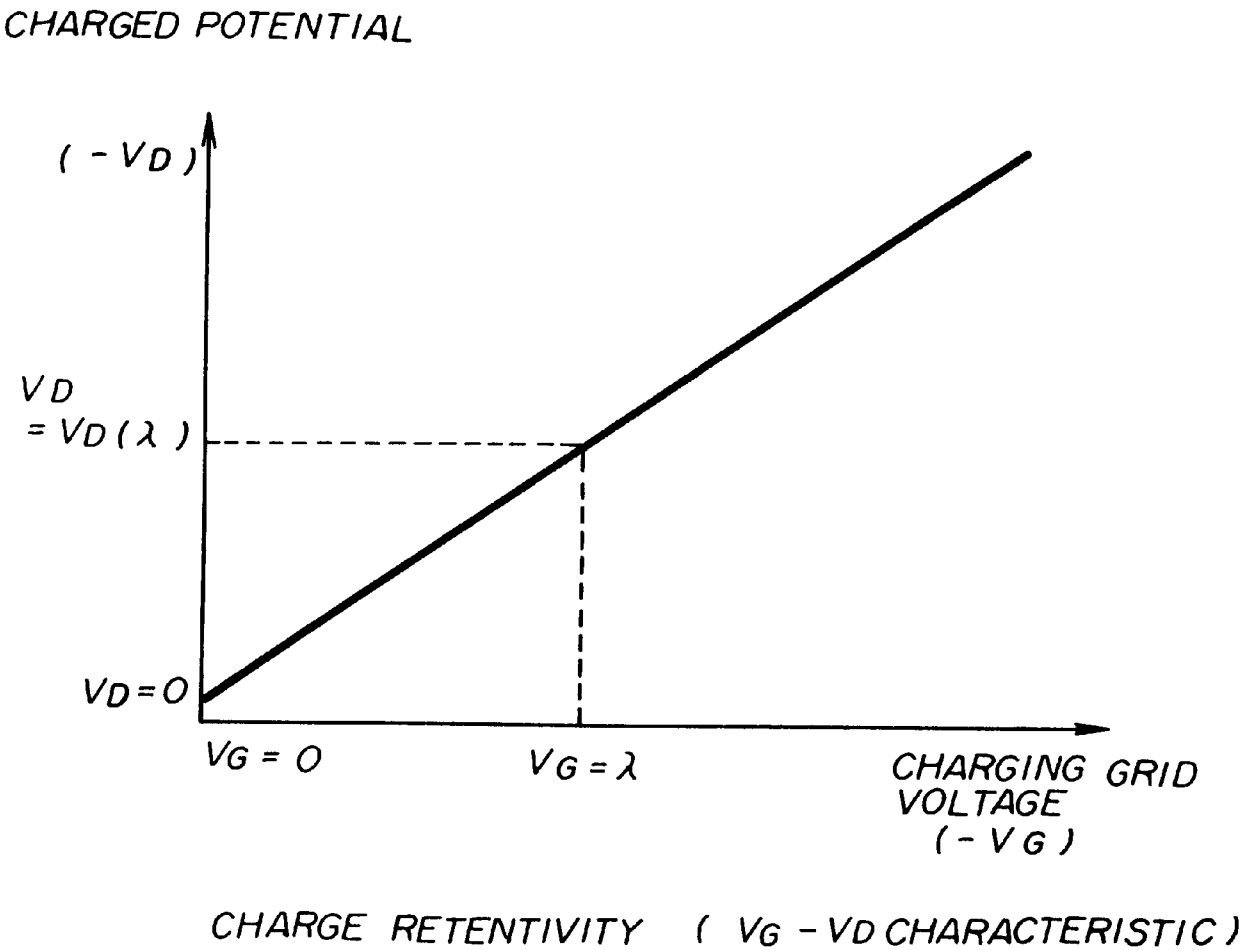
FIG. 4 is a diagram showing a charge retentivity of a photosensitive drum.

FIG. 4 shows the relationship of the charging grid voltage (abscissa) and the charged potential (ordinate). As shown in FIG. 4, the charged potential changes linearly with respect to the charging grid voltage. However, the charged potential not only varies depending on the charging grid voltage, but also varies depending on the environmental factors such as the temperature and humidity and the change in the sensitivity of the photosensitive drum 10. In addition, for a given amount of charge (charger voltage and/or charging grid voltage), the sensitivity of the photosensitive drum 10 after making successive prints decreases, and the absolute value of the charged potential decreases in general. Accordingly, it becomes possible to estimate the sensitivity of the photosensitive drum 10 when the next print is made by monitoring the sensitivity of the photosensitive drum 10, that is, by monitoring the degree of ease or difficulty with which the photosensitive drum 10 is charged.

Figure 5:
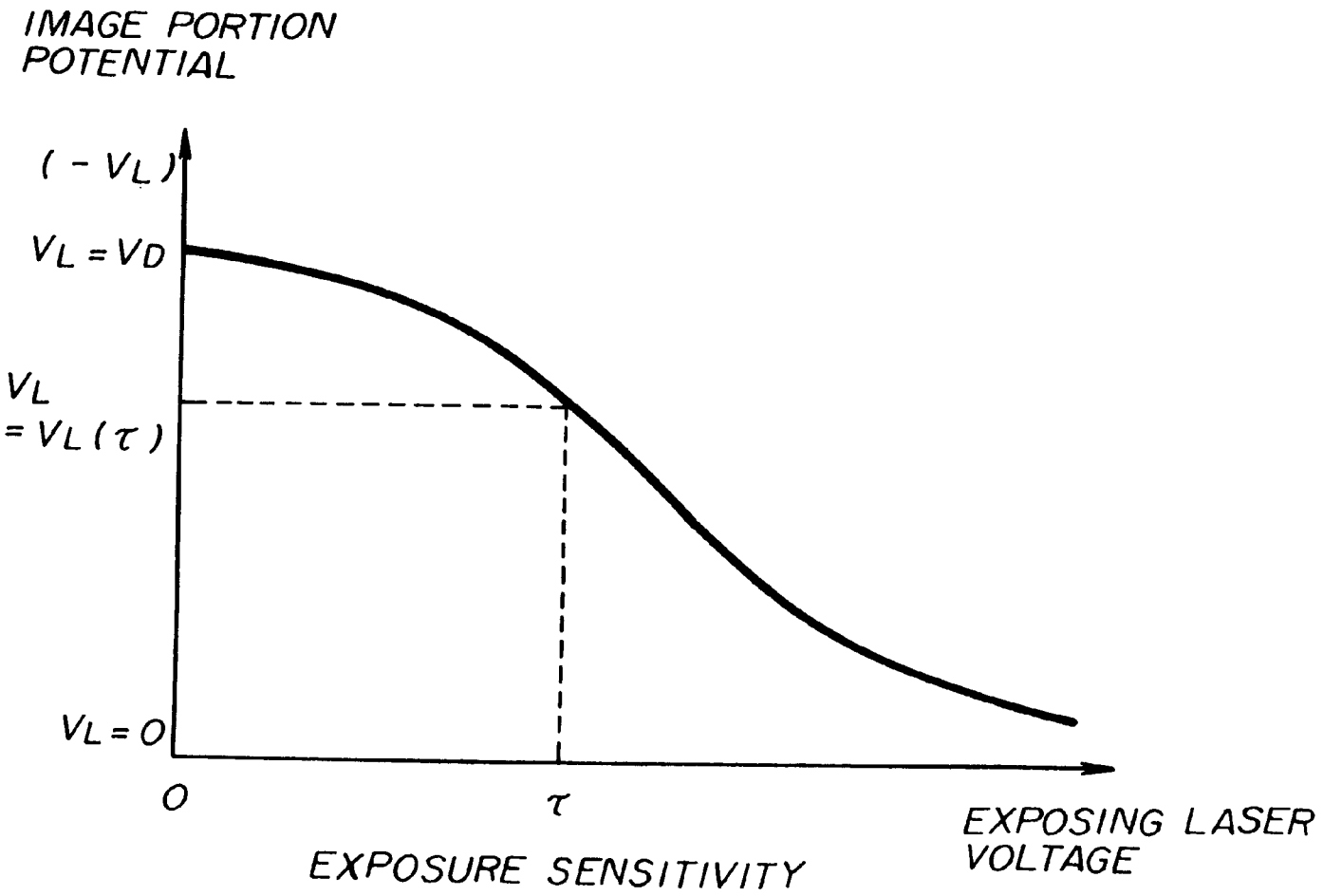
FIG. 5 is a diagram showing an exposure sensitivity of the photosensitive drum.

FIG. 5 shows the relationship of the exposing laser diode or lamp voltage (abscissa) and the potential of the exposed portion (ordinate). The exposure sensitivity also changes depending on the environmental factors and the sensitivity fatigue. Similarly as in the case of the charger 11, it is important to know the change in the sensitivity of the photosensitive drum 10 in order to estimate the exposed portion potential at the time of the next printing operation.

Figure 6:
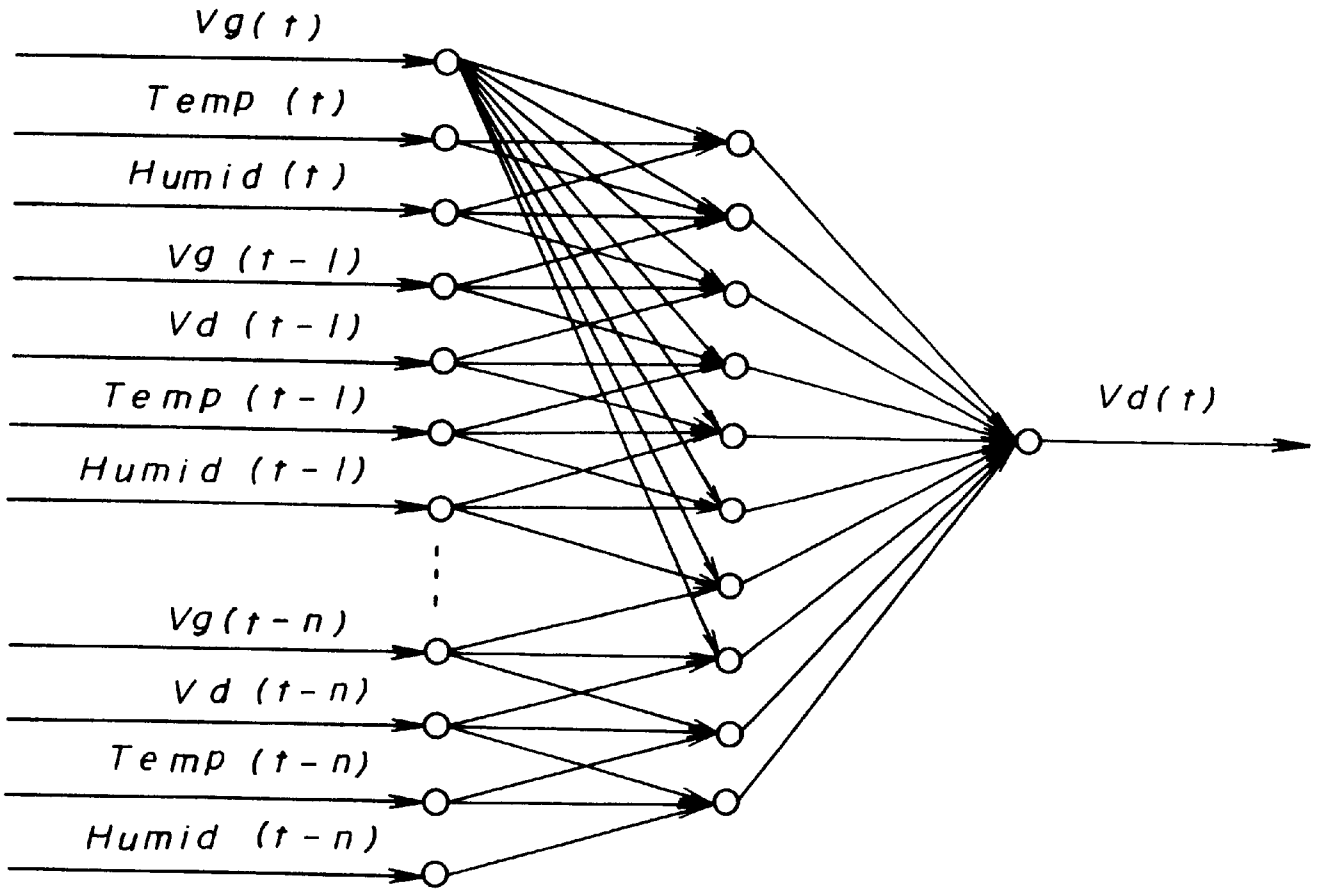
FIG. 6 is a diagram showing the construction of a neural network used for estimating a charged potential of the photosensitive drum in first and fourth embodiments of the potential estimation apparatus according to the present invention.

FIG. 6 shows the construction of the neural network 34 which estimates the latent image potential of the photosensitive drum 10 based on the outputs of the sensor group 30 shown in FIG. 2. The neural network 34 carries out a learning operation according to an error back propagation technique or the like so that errors between the resulting outputs and the teaching values are reduced.

Next, a general description will be given of the neural networks 34 shown in FIGS. 6 through 10 in a learning mode when using the neural networks 34 to control the electrophotography process.

In experiments which were conducted to obtain the learning data from the neural networks 34 shown in FIGS. 6 through 10, (n+1) prints were made while changing the combinations of the environmental conditions such as the amount of charge (charger voltage, charging grid voltage and the like), the amount of exposure (the exposing laser diode or lamp voltage and the like), the temperature, humidity and the like. Alternatively, the experiments were conducted by forming a potential measuring pattern on the photosensitive drum and sampling the surface potentials of the charged and exposed portions which may vary depending on the variation introduced at the manufacturing stage of the photosensitive drum for various photosensitive drums with respect to (n+1) prints. In this latter case, the sampling need not be made for each print, and one sampling may be made for every two or more prints.

Figure 9:
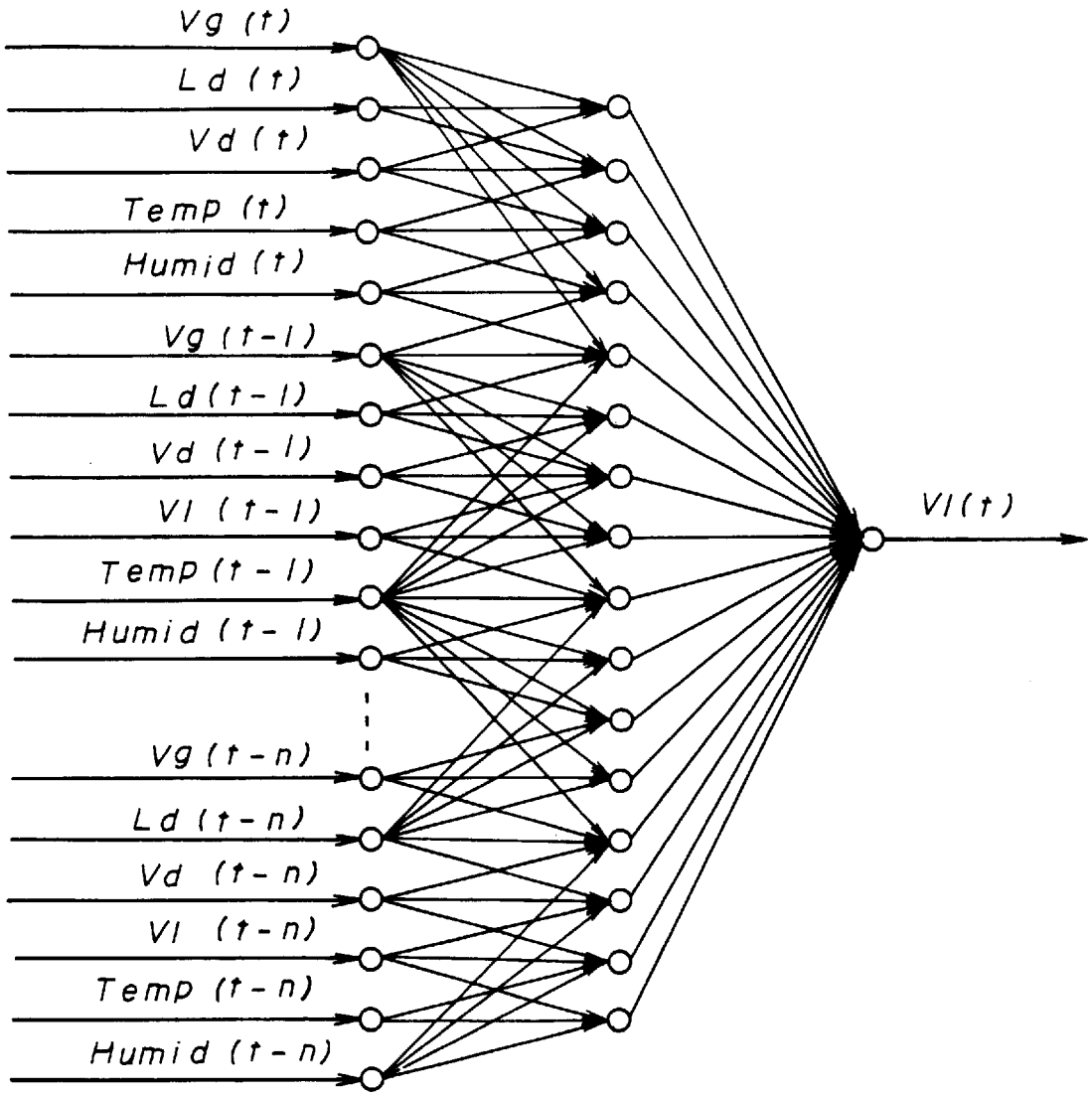
FIG. 9 is a diagram showing the construction of a neural network used for estimating an exposed portion potential of the photosensitive drum in fourth and fifth embodiments of the potential estimation apparatus according to the present invention.

The environmental conditions, the amount of charge and the amount of exposure obtained for each of the first through (n+1)th prints and the charged potential and the exposed portion potential obtained for each of the first through nth prints (also those obtained for the (n+1)th print in the case of the neural network 34 shown in FIG. 9) are input to the input layer of the neural network 34. In addition, the charged portion potential and/or the exposed portion potential obtained for the (n+1)th print is/are input to the output layer of the neural network 34 as the teaching value/values.

In experiments which were conducted to obtain the learning data from the neural networks 34 shown in FIGS. 11 through 15, the prints were made while changing the combinations of the environmental conditions such as the amount of charge (charger voltage, charging grid voltage and the like), the amount of exposure (the exposing laser diode or lamp voltage and the like), the temperature, humidity and the like. The surface potentials of the charged portion and the exposed portion of the photosensitive drum 10 were sampled for various photosensitive drums with respect to (n+1) prints. At the same time, the potentials of the patterns which are charged and exposed at constant values are also sampled. In this case, the sampling does not need to be made for each print, and one sampling may be made for every two or more prints.

Figure 14:
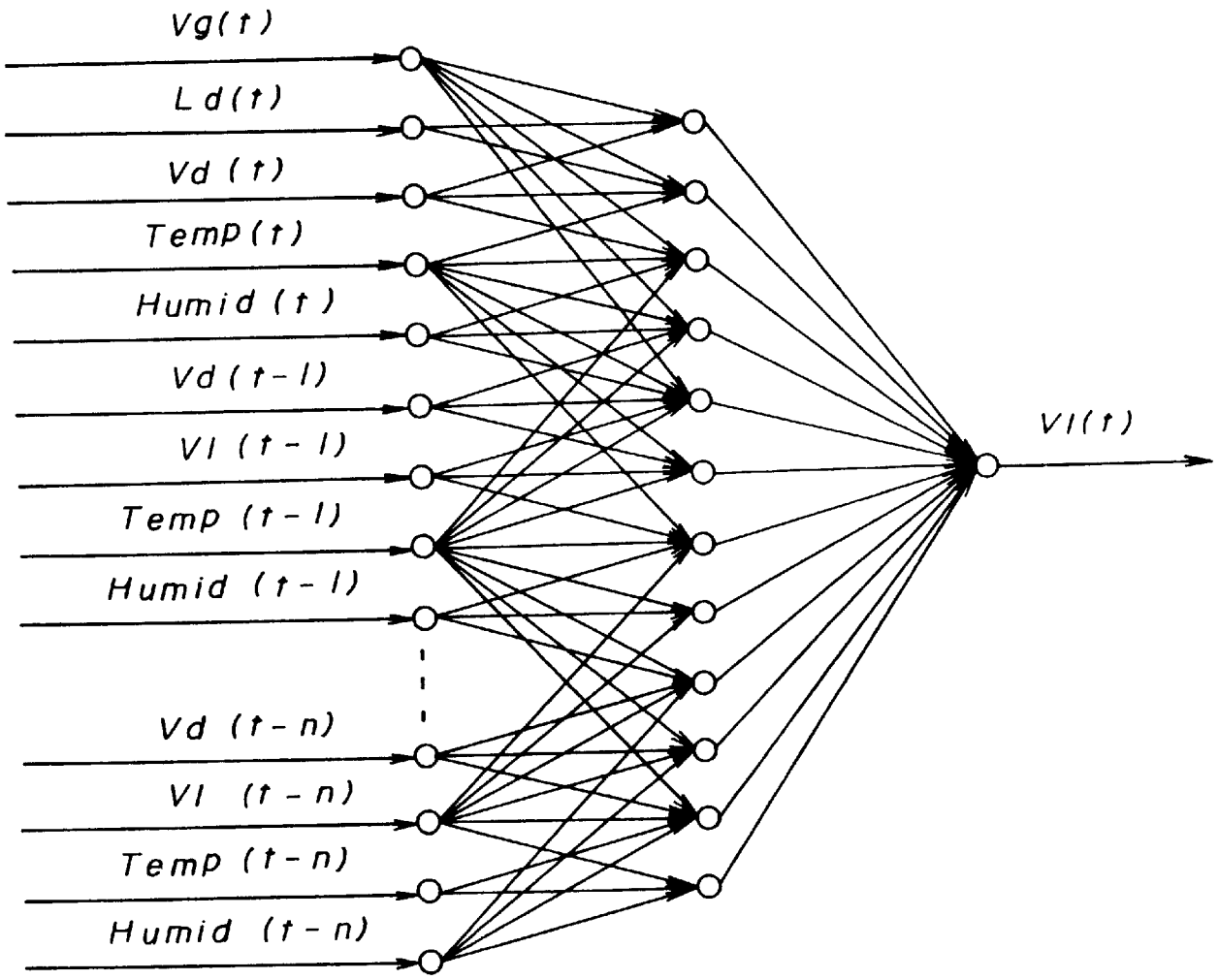
FIG. 14 is a diagram showing the construction of a neural network used for estimating an exposed portion potential of the photosensitive drum in tenth and eleventh embodiments of the potential estimation apparatus according to the present invention.

The amount of charge and the amount of exposure obtained for the (n+1)th print, the environmental conditions obtained for each of the first through (n+1)th prints, and the pattern potentials obtained for each of the first through nth prints (also those obtained for the (n+1)th sampling in the case of the neural network 34 shown in FIG. 14) are input to the input layer of the neural network 34. In addition, the charged portion potential and/or the exposed portion potential obtained for the (n+1)th print is/are input to the output layer of the neural network 34 as the teaching value/values.

The neural networks 34 shown in FIGS. 11 through 15 differ from the neural networks 34 shown in FIGS. 6 through 10 in that the neural network 34 shown in FIGS. 11 through 15 estimate the latent image potential of the image portion for the next print based on the potential of the pattern which is charged and/or exposed with a constant amount of charge and/or amount of exposure.

Next, a description will be given of the first embodiment of the potential estimation apparatus according to the present invention, by referring to FIG. 6.

This first embodiment includes the neural network 34 shown in FIG. 6 which has already learned as described above for generating the charged potential, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30 and the amount of charge.

In FIG. 6, each circular mark indicates a neuron unit of the neural network 34. In addition, Vg(t) denotes the control input of the charge, Temp(t) denotes the temperature, Humid (t) denotes the humidity, Vg(t−1) denotes the charging grid and/or charger voltage, Vd(t−1) denotes the charged potential, Temp(t−1) denotes the temperature, Humid(t−1) denotes the humidity, Vg(t−n) denotes the charging grid and/or charger voltage, Vd(t−n) denotes charged potential, Temp(t−n) denotes the temperature, Humid(t−n) denotes the humidity, and Vd(t) denotes the estimated charged potential.

When the copying machine repeats the copying process, at least one of the parameters which affect the charge retentivity of the photosensitive drum 10, such as the outputs of the sensor group 30 which are time-sequentially sampled and the amount of charge stored in the memory unit 32, is applied to the neural network 34 as the input. As a result, the neural network 34 estimates the charged potential Vd(t) of the next print based on the charge retentivity which was obtained by the learning function of the neural network 34. The control input of the charge for obtaining the target charged potential is obtained by the parameter input unit 36, and the control input of the charge is supplied to the charge controller 20 shown in FIG. 1.

Next, a description will be given of the second embodiment of the potential estimation apparatus according to the present invention, by referring to FIG. 7.

Figure 7:
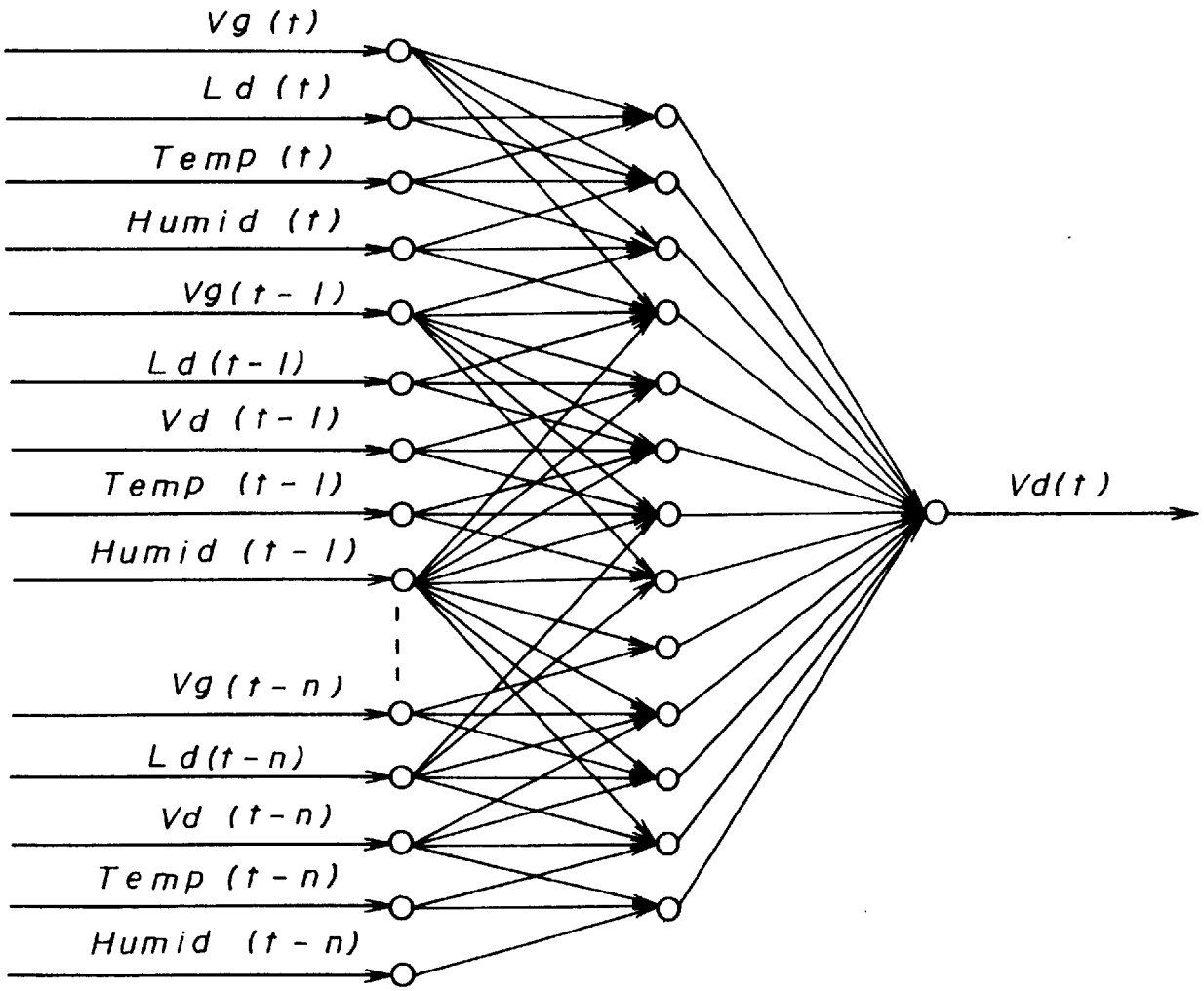
FIG. 7 is a diagram showing the construction of a neural network used for estimating a charged potential of the photosensitive drum in second and fifth embodiments of the potential estimation apparatus according to the present invention.

This second embodiment includes the neural network 34 shown in FIG. 7 which has already learned as described above for generating the charged potential, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure.

As may be seen by comparing the input layers of the neural networks 34 shown in FIGS. 6 and 7, the neural network 34 shown in FIG. 7 carries out beforehand the learning process related to the charge retentivity by additionally using the parameters related to the control input of the exposure and the exposing laser or lamp voltage.

In FIG. 7, each circular mark indicates a neuron unit of the neural network 34. In addition, Vg(t) denotes the control input of the charge, Ld(t) denotes the control input of the exposure, Temp(t) denotes the temperature, Humid(t) denotes the humidity, Vg(t−1) denotes the charging grid and/or charger voltage, Ld(t−1) denotes the exposing laser or lamp voltage, Vd(t−1) denotes the charged potential, Temp(t−1) denotes the temperature, Humid(t−1) denotes the humidity, Vg(t−n) denotes the charging grid and/or charger voltage, Ld(t−n) denotes the exposing laser or lamp voltage, Vd(t−n) denotes charged potential, Temp(t−n) denotes the temperature, Humid(t−n) denotes the humidity, and Vd(t) denotes the estimated charged potential.

When the copying machine repeats the copying process, at least one of the parameters which affect the charge retentivity of the photosensitive drum 10, such as the outputs of the sensor group 30 which are time-sequentially sampled, the amount of charge and the amount of exposure stored in the memory unit 32, is applied to the neural network 34 as the input. As a result, the neural network 34 estimates the charged potential Vd(t) of the next print based on the charge retentivity which was obtained by the learning function of the neural network 34. The control input of the charge and the control input of the exposure for obtaining the target charged potential are obtained by the parameter input unit 36, and the control input of the charge and the control input of the exposure are supplied to the charge controller 20 and the exposure controller 8 shown in FIG. 1.

This second embodiment is mainly applicable to an analog copying machine. If it is impossible to measure only the charged portion potential and the potential of a specific pattern (white pattern, black pattern) is to be controlled, it is necessary to control both the control input of the charge and the control input of the exposure because the potential of the white pattern (in the case of a regular developing technique, and black pattern in the case of a reversed developing technique) also changes depending on the control input of the exposure.

Next, a description will be given of the third embodiment of the potential estimation apparatus according to the present invention, by referring to FIG. 8.

Figure 8:
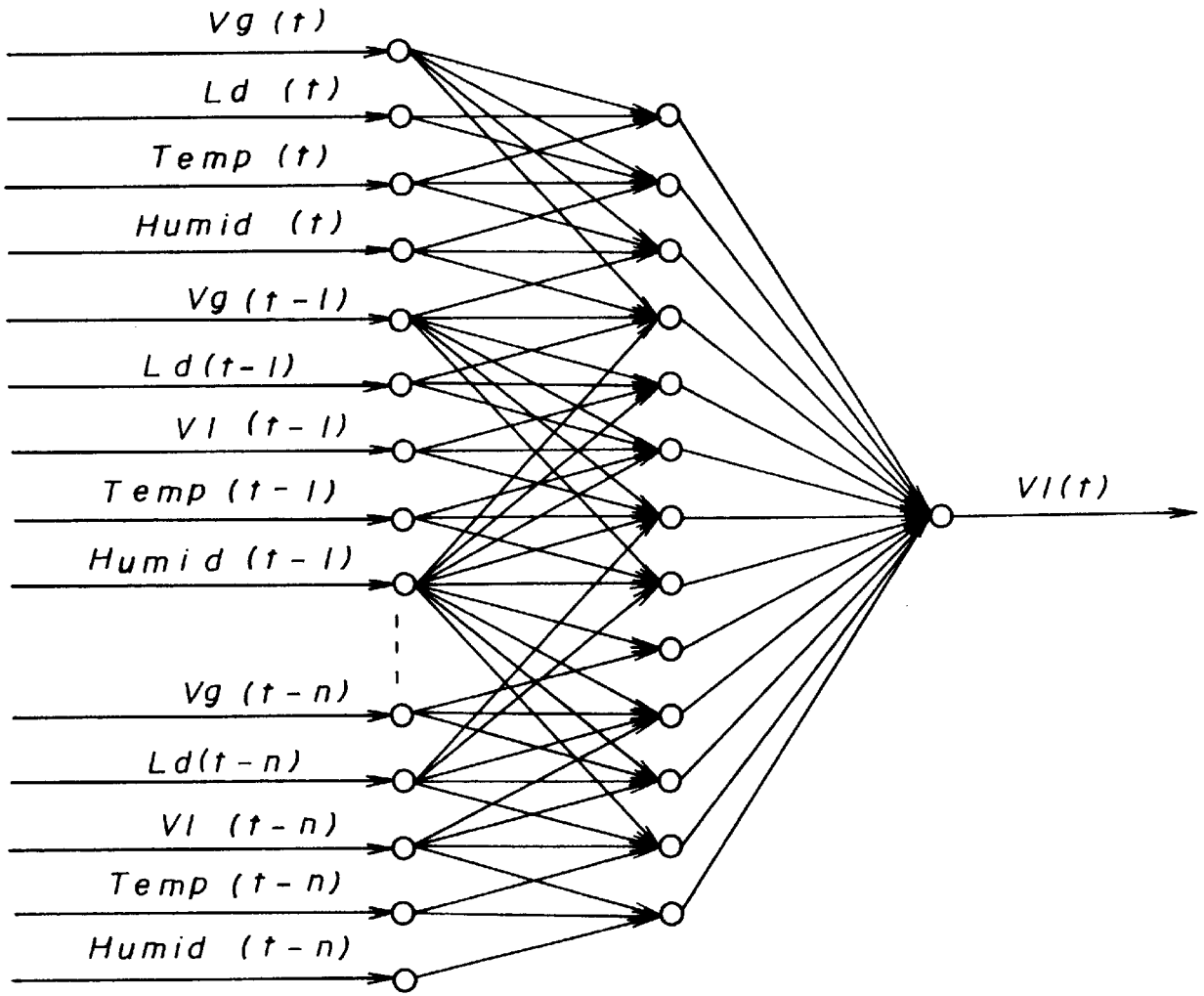
FIG. 8 is a diagram showing the construction of a neural network used for estimating an exposed portion potential of the photosensitive drum in a third embodiment of the potential estimation apparatus according to the present invention.

This third embodiment includes the neural network 34 shown in FIG. 8 which has already learned as described above for generating the exposed portion potential, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure.

In FIG. 8, each circular mark indicates a neuron unit of the neural network 34. In addition, Vg(t) denotes the control input of the charge, Ld(t) denotes the control input of the exposure, Temp(t) denotes the temperature, Humid(t) denotes the humidity, Vg(t−1) denotes the charging grid and/or charger voltage, Ld(t−1) denotes the exposing laser or lamp voltage, Vl(t−1) denotes the exposed portion potential, Temp(t−1) denotes the temperature, Humid(t−1) denotes the humidity, Vg(t−n) denotes the charging grid and/or charger voltage, Ld(t−n) denotes the exposing laser or lamp voltage, Vl(t−n) denotes exposed portion potential, Temp(t−n) denotes the temperature, Humid(t−n) denotes the humidity, and Vl(t) denotes the estimated exposed portion potential.

When the copying machine repeats the copying process, at least one of the parameters which affect the charge retentivity of the photosensitive drum 10, such as the outputs of the sensor group 30 which are time-sequentially sampled, the amount of charge and the amount of exposure stored in the memory unit 32, is applied to the neural network 34 as the input. As a result, the neural network 34 estimates the exposed portion potential Vl(t) of the next print based on the charge retentivity which was obtained by the learning function of the neural network 34. The control input of the amount of charge and the control input of the amount of exposure (control input of the exposing laser or lamp voltage) for obtaining the target exposed portion potential are obtained by the parameter input unit 36, and the control input of the amount of charge and the control input of the amount of exposure are respectively supplied to the charge controller 20 and the exposure controller 8 shown in FIG. 1.

Next, a description will be given of the fourth embodiment of the potential estimation apparatus according to the present invention, by referring to FIGS. 6, 9 and 16.

Figure 16:
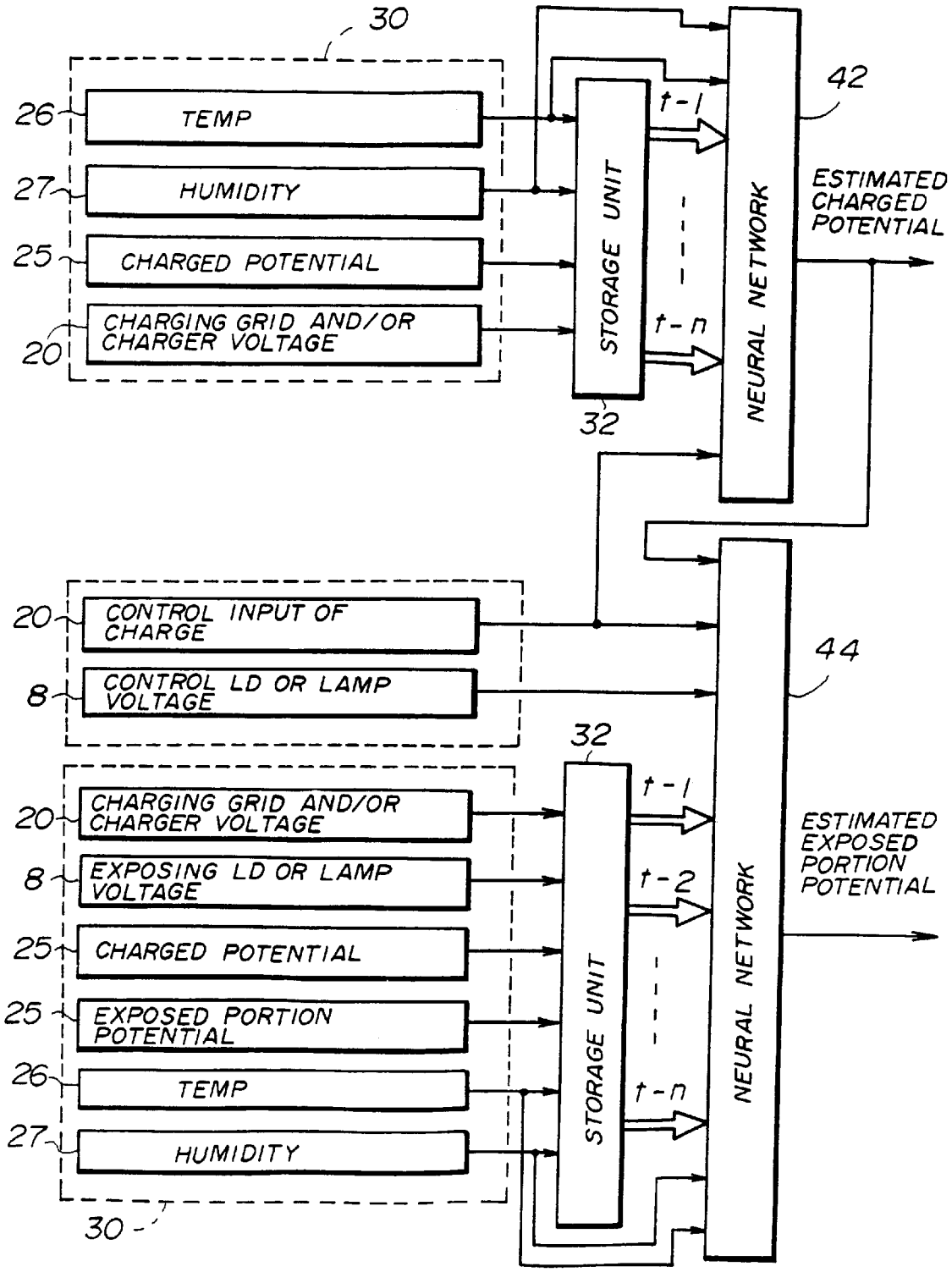
FIG. 16 is a system block diagram showing the construction of the fourth embodiment of the potential estimation apparatus according to the present invention.

This fourth embodiment includes a neural network 42 shown in FIG. 16 which has already learned as described above for generating the charged potential similarly to the first embodiment, a neural network 44 shown in FIG. 16 which has already learned as described above for generating the exposed portion potential similarly to the neural network 34 shown in FIG. 9. the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure. As shown in FIG. 16, the neural network 34 shown in FIG. 2 is made up of the neural networks 42 and 44, the sensor group 30 is made up of two parts, and the memory unit 32 is also made up of two parts.

In FIG. 9, each circular mark indicates a neuron unit of the neural network 34. In addition, Vg(t) denotes the control input of the charge, Ld(t) denotes the control input of the exposure, Temp(t) denotes the temperature, Humid(t) denotes the humidity, Vg(t−1) denotes the charging grid and/or charger voltage, Ld(t−1) denotes the exposing laser or lamp voltage, Vd(t−1) denotes the charged potential, Vl(t−1) denotes the exposed portion potential, Temp(t−1) denotes the temperature, Humid(t−1) denotes the humidity, Vg(t−n) denotes the charging grid and/or charger voltage, Ld(t−n) denotes the exposing laser or lamp voltage, Vd(t−n) denotes the charged potential, Vl(t−n) denotes exposed portion potential, Temp(t−n) denotes the temperature, Humid(t−n) denotes the humidity, and Vl(t) denotes the estimated exposed portion potential.

When the copying machine repeats the copying process, at least one of the parameters which affect the exposure sensitivity of the photosensitive drum 10, such as the outputs of the sensor group 30 which are time-sequentially sampled, and the amount of charge and the amount of exposure stored in the memory unit 32, and the output of the neural network 42, are applied to the neural network 44 as the inputs. As a result, the neural network 44 estimates the exposed portion potential Vl(t) of the next print based on the exposure sensitivity which was obtained by the learning function of the neural network 44. The control input of the amount of exposure (control input of the exposing laser or lamp voltage) for obtaining the target exposed portion potential is obtained by the parameter input unit 36, and the control input of the amount of exposure is supplied to the exposure controller 8 shown in FIG. 1. In this case, the control input of the charge and the control input of the exposure must be determined so that both the estimated charged potential and the estimated exposed portion potential become target values.

Next, a description will be given of the fifth embodiment of the potential estimation apparatus according to the present invention, by referring to FIGS. 7, 9 and 17.

Figure 17:
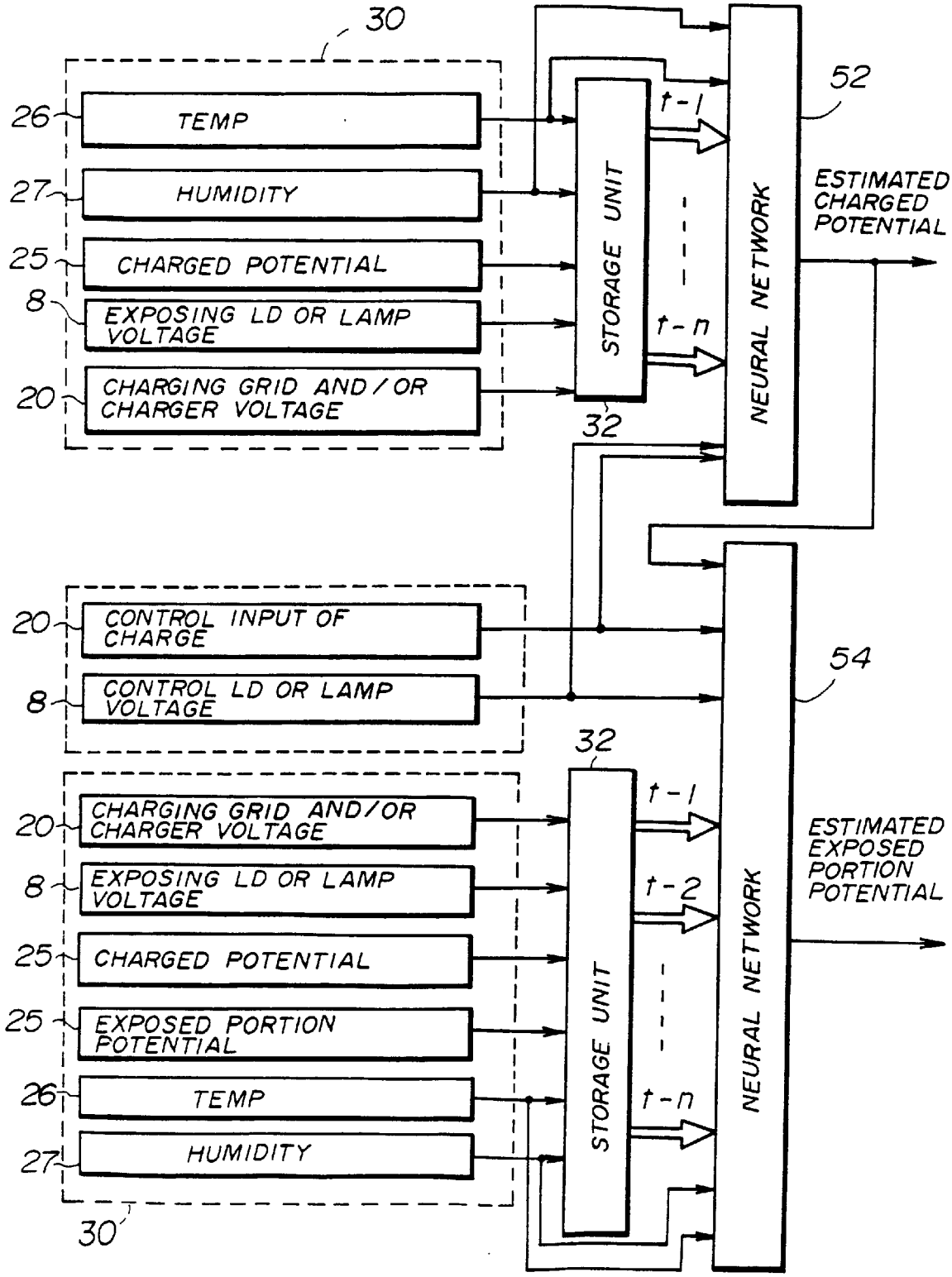
FIG. 17 is a system block diagram showing the construction of the fifth embodiment of the potential estimation apparatus according to the present invention.

This fifth embodiment includes a neural network 52 shown in FIG. 17 which has already learned as described above for generating the charged potential similarly to the second embodiment, a neural network 54 which has already learned as described above for generating the exposed portion potential similarly to the neural network 34 shown in FIG. 9, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure. As shown in FIG. 17, the neural network 34 shown in FIG. 2 is made up of the neural networks 52 and 54, the sensor group 30 is made up of two parts, and the memory unit 32 is also made up of two parts.

When the copying machine repeats the copying process, at least one of the parameters which affect the exposure sensitivity of the photosensitive drum 10, such as the outputs of the sensor group 30 which are time-sequentially sampled, and the amount of charge and the amount of exposure stored in the memory unit 32, and the output of the neural network 52, are applied to the neural network 54 as the inputs. As a result, the neural network 54 estimates the exposed portion potential Vl(t) of the next print based on the exposure sensitivity which was obtained by the learning function of the neural network 54. The control input of the amount of exposure (control input of the exposing laser or lamp voltage) for obtaining the target exposed portion potential is obtained by the parameter input unit 36, and the control input of the amount of exposure is supplied to the exposure controller 8 shown in FIG. 1. In this case, the control input of the charge and the control input of the exposure must be determined so that both the estimated charged potential and the estimated exposed portion potential become target values.

Next, a description will be given of the sixth embodiment of the potential estimation apparatus according to the present invention, by referring to FIG. 10.

Figure 10:
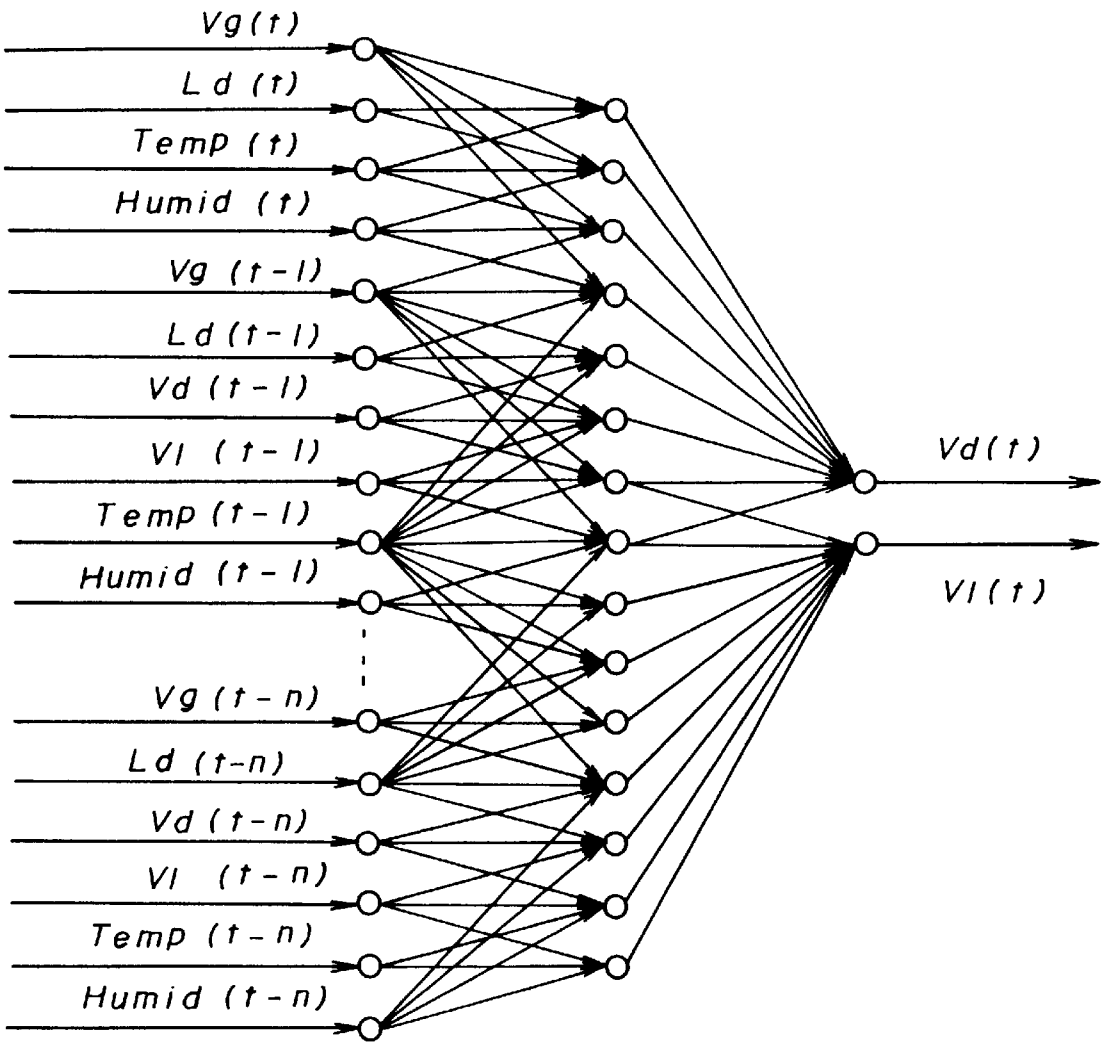
FIG. 10 is a diagram showing the construction of a neural network used for estimating a charged potential and an exposed portion potential of the photosensitive drum in a sixth embodiment of the potential estimation apparatus according to the present invention.

This sixth embodiment includes the neural network 34 shown in FIG. 10 which has already learned as described above for generating the charged potential and the exposed portion potential, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure.

In FIG. 10, each circular mark indicates a neuron unit of the neural network 34. In addition, Vg(t) denotes the control input of the charge, Ld(t) denotes the control input of the exposure, Temp(t) denotes the temperature, Humid(t) denotes the humidity, Vg(t−1) denotes the charging grid and/or charger voltage, Ld(t−1) denotes the exposing laser or lamp voltage, Vd(t−1) denotes the charged potential, Vl(t−1) denotes the exposed portion potential, Temp(t−1) denotes the temperature, Humid(t−1) denotes the humidity, Vg(t−n) denotes the charging grid and/or charger voltage, Ld(t−n) denotes the exposing laser or lamp voltage, Vd(t−n) denotes the charged potential, Vl(t−n) denotes exposed portion potential, Temp(t−n) denotes the temperature, Humid(t−n) denotes the humidity, Vd(t) denotes the estimated charged potential, and Vl(t) denotes the estimated exposed portion potential.

When the copying machine repeats the copying process, at least one of the parameters which affect the charge retentivity and the exposure sensitivity of the photosensitive drum 10, such as the outputs of the sensor group 30 which are time-sequentially sampled, the amount of charge and the amount of exposure stored in the memory unit 32, is applied to the neural network 34 as the input. As a result, the neural network 34 estimates the latent image potential of the next print based on the charge retentivity and the exposure sensitivity which were obtained by the learning function of the neural network 34. The control input of the amount of charge (control input of the charger voltage and/or charging grid voltage) and the amount of exposure (control input of the exposing laser or lamp voltage) for obtaining the target latent image potential are obtained by the parameter input unit 36, and the control input of the amount of charge and the amount of exposure are respectively supplied to the charge controller 20 and the exposure controller 8 shown in FIG. 1.

Next, a description will be given of the seventh embodiment of the potential estimation apparatus according to the present invention, by referring to FIG. 11.

Figure 11:
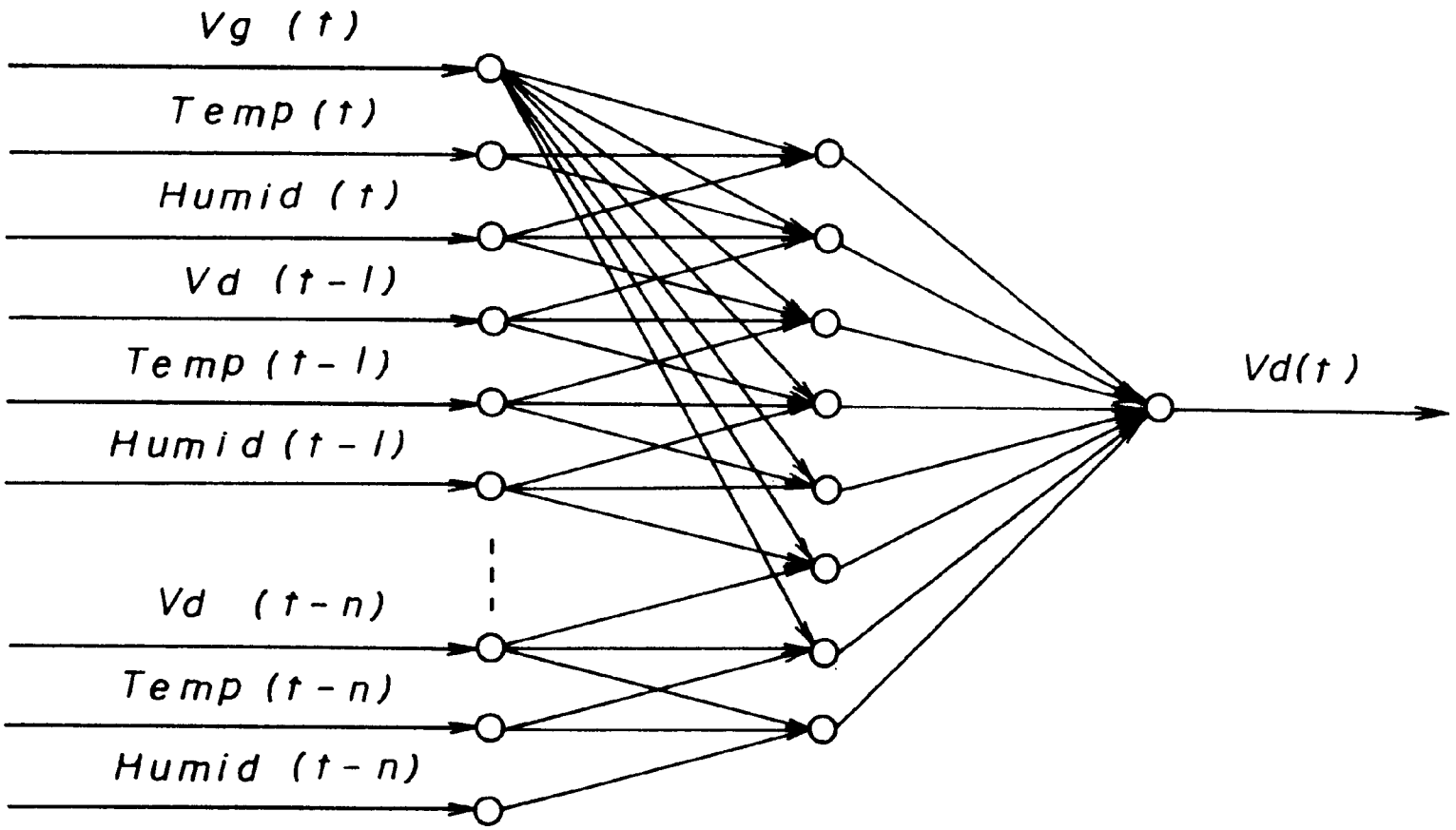
FIG. 11 is a diagram showing the construction of a neural network used for estimating a charged potential of the photosensitive drum in seventh and tenth embodiments of the potential estimation apparatus according to the present invention.

This seventh embodiment includes the neural network 34 shown in FIG. 11 which has already learned as described above for generating the charged potential, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure.

In FIG. 11, each circular mark indicates a neuron unit of the neural network 34. In addition, Vg(t) denotes the control input of the charge, Temp(t) denotes the temperature, Humid (t) denotes the humidity, Vd(t−1) denotes the charged potential, Vl(t−1) denotes the exposed portion potential, Temp(t−1) denotes the temperature, Humid(t−1) denotes the humidity, Vd(t−n) denotes the charged potential, Temp(t−n) denotes the temperature, Humid(t−n) denotes the humidity, and Vd(t) denotes the estimated charged potential.

When the copying machine repeats the copying process, at least one of the amount of charge, the charged potential of the pattern which is used for measuring the latent image potential and is time-sequentially sampled, and the environmental conditions such as the temperature and humidity, is applied to the neural network 34 as the input. As a result, the neural network 34 estimates the charged potential of the image portion of the next print based on the charge retentivity which was obtained by the learning function of the neural network 34. The control input of the charge (control input of the charger voltage and/or charging grid voltage) for obtaining the target charged potential is obtained by the parameter input unit 36, and the control input of the charge is supplied to the charge controller 20 shown in FIG. 1. According to this embodiment, it is possible to reduce the inputs to the neural network 34 compared to the first embodiment because the charge is made with a constant amount of charge.

Next, a description will be given of the eighth embodiment of the potential estimation apparatus according to the present invention, by referring to FIG. 12.

Figure 12:
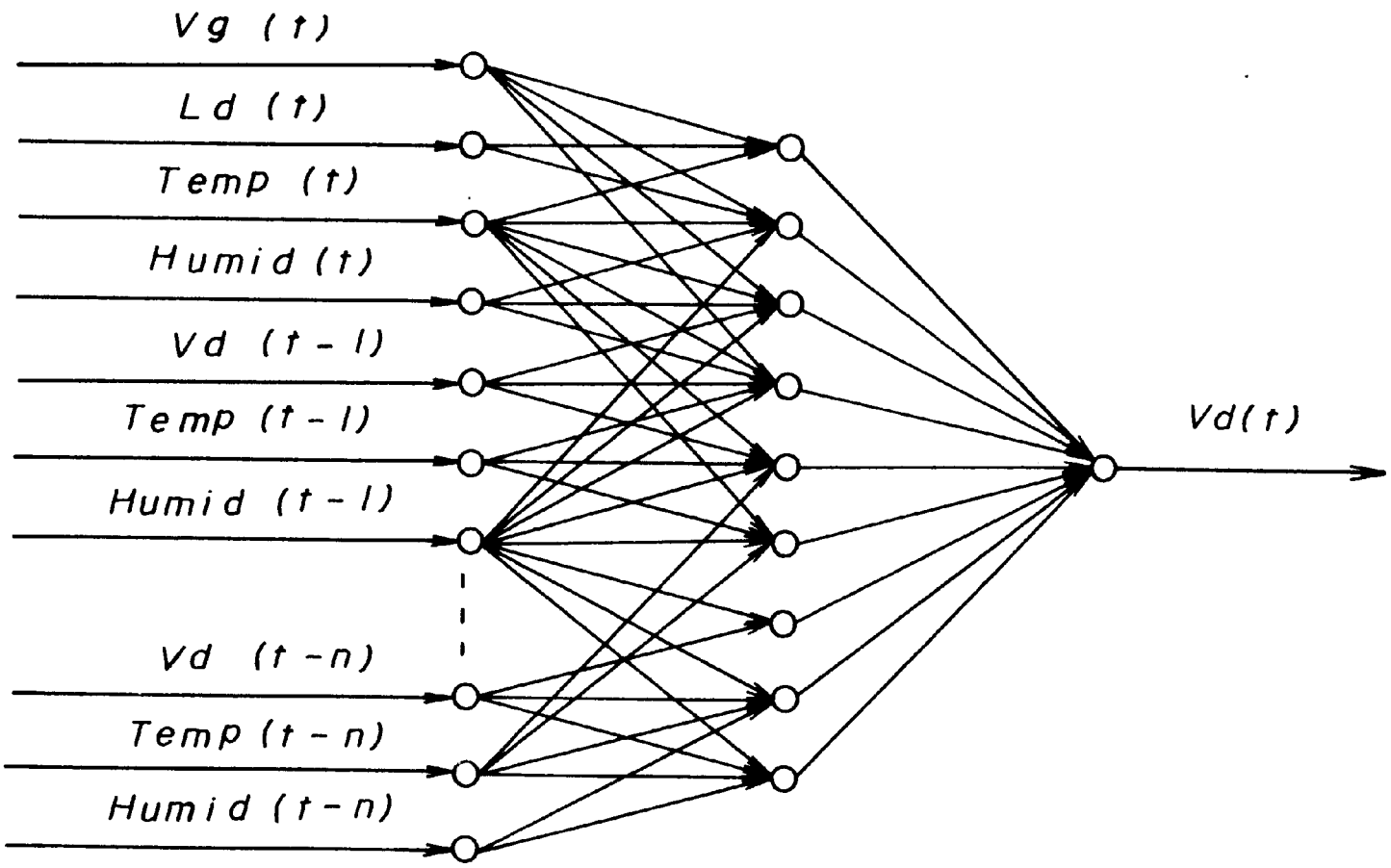
FIG. 12 is a diagram showing the construction of a neural network used for estimating a charged potential of the photosensitive drum in eighth and eleventh embodiments of the potential estimation apparatus according to the present invention.

This eighth embodiment includes the neural network 34 shown in FIG. 12 which has already learned as described above for generating the charged potential, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure.

In FIG. 12, each circular mark indicates a neuron unit of the neural network 34. In addition, Vg(t) denotes the control input of the charge, Ld(t) denotes the control input of the exposure, Temp(t) denotes the temperature, Humid(t) denotes the humidity, Vd(t−1) denotes the charged potential, Temp(t−1) denotes the temperature, Humid(t−1) denotes the humidity, Vd(t−n) denotes the charged potential, Temp(t−n) denotes the temperature, Humid(t−n) denotes the humidity, and Vd(t) denotes the estimated charged potential.

When the copying machine repeats the copying process, at least one of the amount of charge, the amount of exposure, the charged potential of the pattern which is used for measuring the latent image potential and is time-sequentially sampled, and the environmental conditions such as the temperature and humidity, is applied to the neural network 34 as the input. As a result, the neural network 34 estimates the charged potential of the image portion of the next print based on the charge retentivity which was obtained by the learning function of the neural network 34. The control input of the charge (control input of the charger voltage and/or charging grid voltage) and the control input of the exposure (control input of the exposing laser or lamp voltage) for obtaining the target charged potential are obtained by the parameter input unit 36, and the control input of the charge and the control input of the exposure are respectively supplied to the charge controller 20 and the exposure controller 8 shown in FIG. 1.

This eighth embodiment is mainly applicable to the analog copying machine. If it is impossible to measure only the charged portion potential and the potential of a specific pattern (white pattern, black pattern) is to be controlled, it is necessary to control both the control input of the charge and the control input of the exposure because the potential of the white pattern (in the case of a regular developing technique, and black pattern in the case of a reversed developing technique) also changes depending on the control input of the exposure. This eighth embodiment can reduce the inputs to the neural network 34 compared to the second embodiment because the charge and exposure are made with constant amounts of charge and exposure.

Next, a description will be given of the ninth embodiment of the potential estimation apparatus according to the present invention, by referring to FIG. 13.

Figure 13:
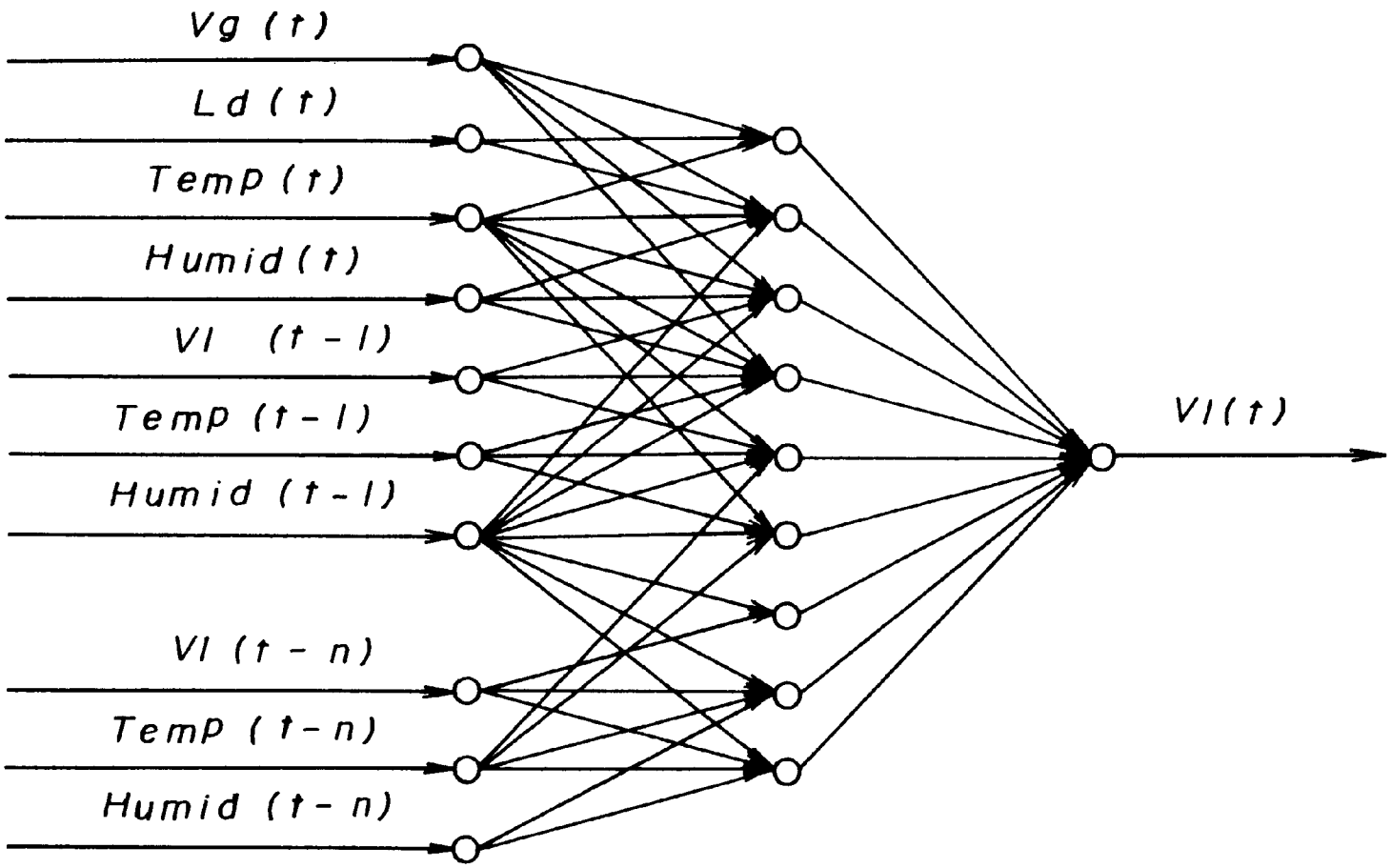
FIG. 13 is a diagram showing the construction of a neural network used for estimating an exposed portion potential of the photosensitive drum in a ninth embodiment of the potential estimation apparatus according to the present invention.

This ninth embodiment includes the neural network 34 shown in FIG. 13 which has already learned as described above for generating the exposure portion potential, the sensor group 30 made up of the surface electrometer 25s the temperature sensor 26 and the humidity sensor 27 which are mounted within the copying machine shown in FIG. 2, and the memory unit 32 which stores the parameters such as the outputs of the sensor group 30, the amount of charge and the amount of exposure.

In FIG. 13, each circular mark indicates a neuron unit of the neural network 34. In addition, Vg(t) denotes the control input of the charge, Ld(t) denotes the control input of the exposure, Temp(t) denotes the temperature, Humid(t) denotes the humidity, Vl(t−1) denotes the exposed portion potential, Temp(t−1) denotes the temperature, Humid(t−1) denotes the humidity, Vl(t−n) denotes the exposed portion potential, Temp(t−n) denotes the temperature, Humid(t−n) denotes the humidity, and Vl(t) denotes the estimated exposed portion potential.

When the copying machine repeats the copying process, at least one of the amount of charge, the amount of exposure, the exposed portion potential of the pattern which is used for measuring the latent image potential and is time-sequentially sampled, and the environmental conditions such as the temperature and humidity, is applied to the neural network 34 as the input. As a result, the neural network 34 estimates the exposed portion potential of the image portion of the next print based on the exposure sensitivity which was obtained by the learning function of the neural network 34. The control input of the charge and the control input of the exposure (control input of the exposing laser or lamp voltage) for obtaining the target exposed portion potential are obtained by the parameter input unit 36, and the control input of the charge and the control input of the exposure are respectively supplied to the charge controller 20 and the exposure controller 8 shown in FIG. 1. According to this embodiment, it is possible to reduce the inputs to the neural network 34 compared to the third embodiment because the charge and exposure are made with constant amounts of charge and exposure.

Next, a description will be given of the tenth embodiment of the potential estimation apparatus according to the present invention, by referring to FIGS. 11, 14 and 18.

Figure 18:
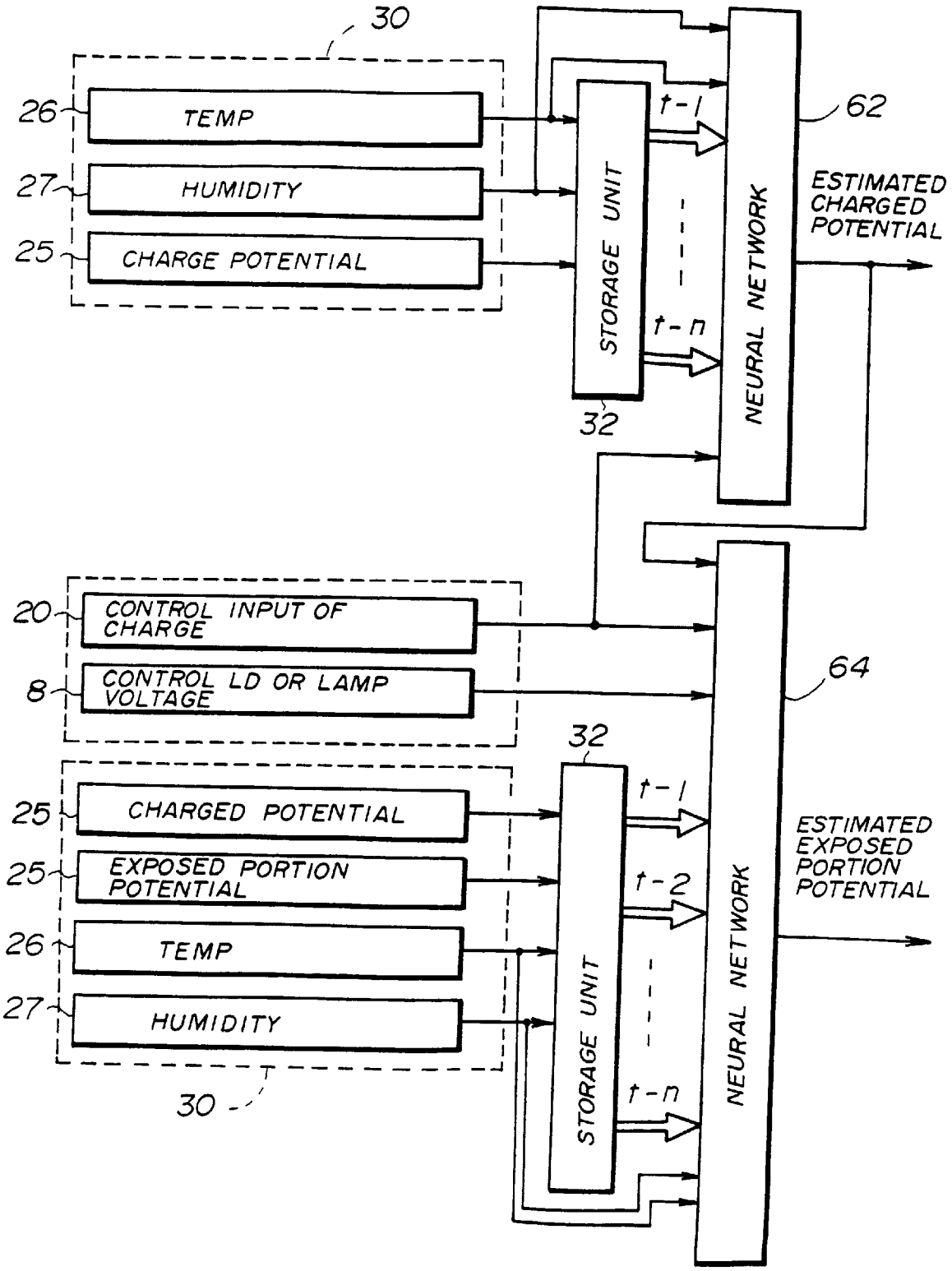
FIG. 18 is a system block diagram showing the construction of the tenth embodiment of the potential estimation apparatus according to the present invention.

This tenth embodiment includes a neural network 62 shown in FIG. 18 which has already learned as described above for generating the charged potential similarly to the seventh embodiment, a neural network 64 shown in FIG. 18 which has already learned as described above for the exposure portion potential similarly to the neural network 34 shown in FIG. 14, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure. As shown in FIG. 18, the neural network 34 shown in FIG. 2 is made up of the neural networks 62 and 64, the sensor group 30 is made up of two parts, and the memory unit 32 is also made up of two parts.

In FIG. 14, each circular mark indicates a neuron unit of the neural network 34. In addition, Vg(t) denotes the control input of the charge, Ld(t) denotes the control input of the exposure, Vd(t) denotes the estimated charged potential, Temp(t) denotes the temperature, Humid(t) denotes the humidity, Vd(t−1) denotes the charged potential, Vl(t−1) denotes the exposed portion potential, Temp(t−1) denotes the temperature, Humid(t−1) denotes the humidity, Vd(t−n) denotes the charged potential, Vl(t−n) denotes the exposed portion potential, Temp(t−n) denotes the temperature, Humid(t−n) denotes the humidity, and Vl(t) denotes the estimated exposed portion potential.

When the copying machine repeats the copying process, at least one of the amount of charge, the amount of exposure, the charged potential and the exposed portion potential of the pattern which is used for measuring the latent image potential and are time-sequentially sampled, and the environmental conditions such as the temperature and humidity, and the output of the neural network 62, are applied to the neural network 64 as the inputs. As a result, the neural network 64 estimates the exposed portion potential of the image portion of the next print based on the exposure sensitivity which was obtained by the learning function of the neural network 64. The control input of the charge and the control input of the exposure (control input of the exposing laser or lamp voltage) for obtaining the target exposed portion potential are obtained by the parameter input unit 36, and the control input of the charge and the control input of the exposure are respectively supplied to the the charge controller 20 and the exposure controller 8 shown in FIG. 1. In this case, the control input of the charge and the control input of the exposure must be determined so that the estimated charged potential and the estimated exposed portion potential become target values. According to this embodiment, it is possible to reduce the inputs to the neural network 34 compared to the fourth embodiment because the charge and exposure are made with constant amounts of charge and exposure.

Next, a description will be given of the eleventh embodiment of the potential estimation apparatus according to the present invention, by referring to FIGS. 12, 14 and 19.

Figure 19:
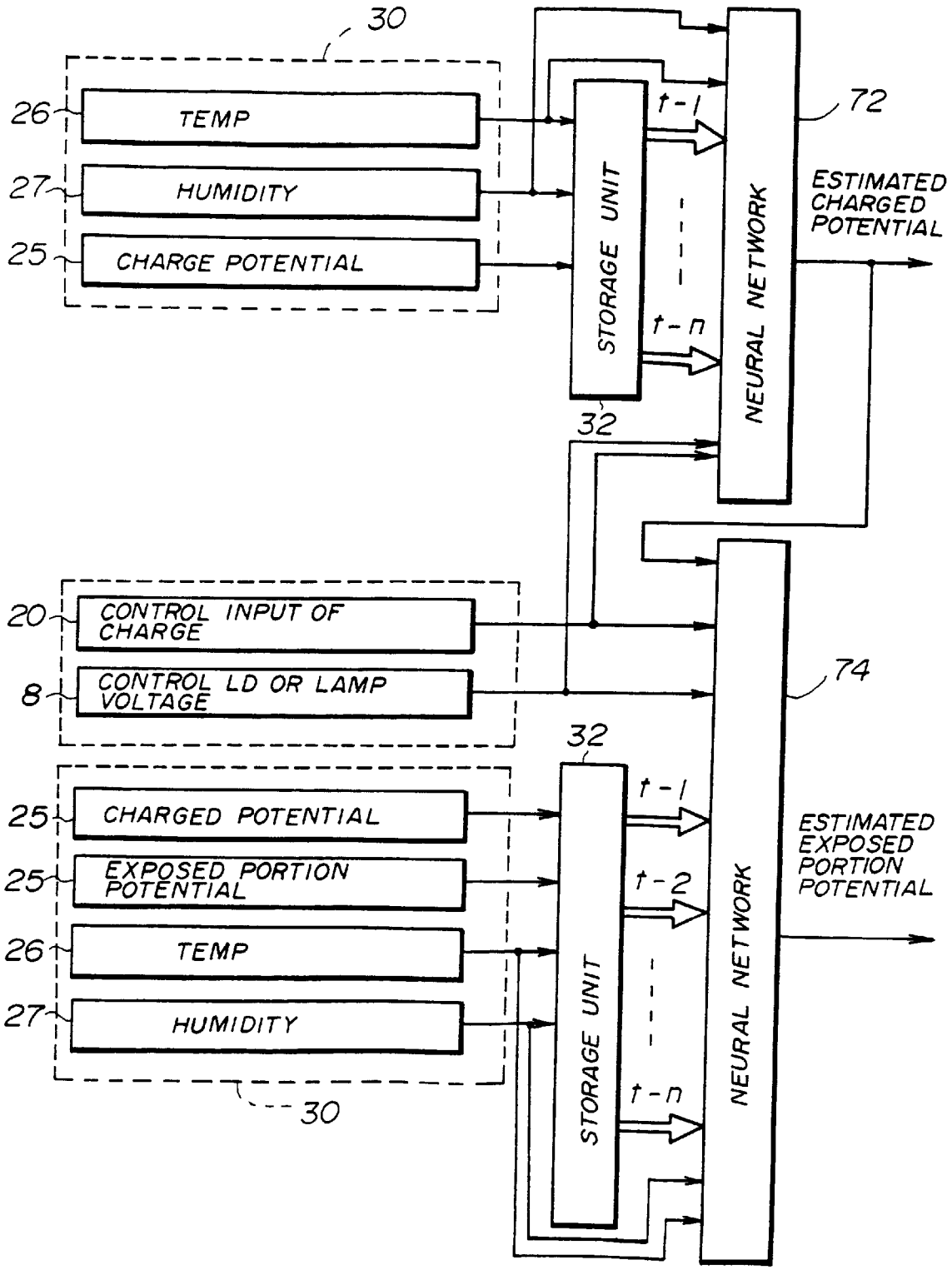
FIG. 19 is a system block diagram showing the construction of the eleventh embodiment of the potential estimation apparatus according to the present invention.

This eleventh embodiment includes a neural network 72 shown in FIG. 19 which has already learned as described above for generating the charged potential similarly to the eighth embodiment, a neural network 74 shown in FIG. 19 which has already learned as described above for the exposure portion potential similarly to the neural network 34 shown in FIG. 14, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure. As shown in FIG. 19, the neural network 34 shown in FIG. 2 is made up of the neural networks 62 and 64, the sensor group 30 is made up of two parts, and the memory unit 32 is also made up of two parts.

When the copying machine repeats the copying process, at least one of the charged potential and the exposed portion potential of the pattern which is used for measuring the latent image potential and are time-sequentially sampled, and the environmental conditions such as the temperature and humidity, and the output of the neural network 72, are applied to the neural network 74 as the inputs. As a result, the neural network 74 estimates the exposed portion potential of the image portion of the next print based on the exposure sensitivity which was obtained by the learning function of the neural network 74. The control input of the charge and the control input of the exposure (control input of the exposing laser or lamp voltage) for obtaining the target exposed portion potential are obtained by the parameter input unit 36, and the control input of the charge and the control input of the exposure are respectively supplied to the the charge controller 20 and the exposure controller 8 shown in FIG. 1. In this case, the control input of the charge and the control input of the exposure must be determined so that the estimated charged potential and the estimated exposed portion potential become target values. According to this embodiment, it is possible to reduce the inputs to the neural network 34 compared to the fifth embodiment because the charge and exposure are made with constant amounts of charge and exposure.

Next, a description will be given of the twelfth embodiment of the potential estimation apparatus according to the present invention, by referring to FIG. 15.

Figure 15:
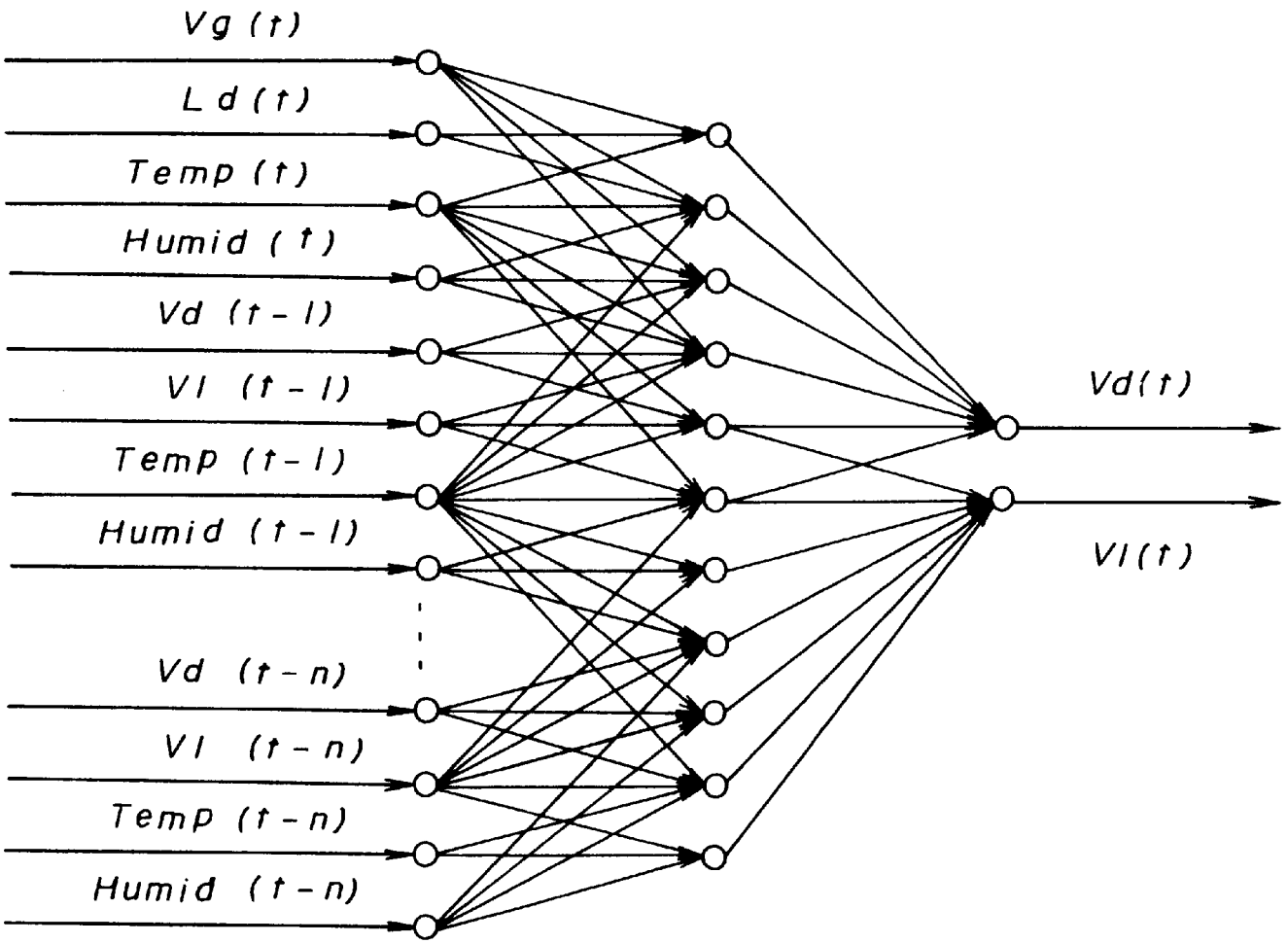
FIG. 15 is a diagram showing the construction of a neural network used for estimating a charged potential and an exposed portion potential of the photosensitive drum in twelfth embodiment of the potential estimation apparatus according to the present invention.

This twelfth embodiment includes the neural network 34 shown in FIG. 15 which has already learned as described above for generating the charged potential and the exposure portion potential, the sensor group 30 made up of the surface electrometer 25, the temperature sensor 26 and the humidity sensor 27 which are mounted within the copying machine shown in FIG. 2, and the memory unit 32 which stores the parameters such as the outputs of the sensor group 30, the amount of charge and the amount of exposure.

In FIG. 15, each circular mark indicates a neuron unit of the neural network 34. In addition, Vg(t) denotes the control input of the charge, Ld(t) denotes the control input of the exposure, Temp(t) denotes the temperature, Humid(t) denotes the humidity, Vd(t−1) denotes the charged potential, Vd(t−n) denotes the charged potential, Vl(t−1) denotes the exposed portion potential, Temp(t−1) denotes the temperature, Humid(t−1) denotes the humidity, Vd(t−n) denotes the charged potential, Vl(t−n) denotes the exposed portion potential, Temp(t−n) denotes the temperature, Humid(t−n) denotes the humidity, Vd(t) denotes the estimated charged potential, and Vl(t) denotes the estimated exposed portion potential.

When the copying machine repeats the copying process, at least one of the charged potential and the exposed portion potential of the pattern which is used for measuring the latent image potential and is time-sequentially sampled, and the environmental conditions such as the temperature and humidity, is applied to the neural network 34 as the input. As a result, the neural network 34 estimates the charged potential of the image portion and the exposed portion potential of the next print based on the charge retentivity and the exposure sensitivity which were obtained by the learning function of the neural network 34. The control input of the charge (control input of the charger voltage and/or charging grid voltage) and control input of the exposure (control input of the exposing laser or lamp voltage) for obtaining the target charged potential and the target exposed portion potential are obtained by the parameter input unit 36, and the control input of the charge and the control input of the exposure are respectively supplied to the charge controller 20 and the exposure controller 8 shown in FIG. 1. According to this embodiment, it is possible to reduce the inputs to the neural network 34 compared to the sixth embodiment because the charge and exposure are made with constant amounts of charge and exposure.

Although the described embodiments use the surface electrometer 25, the temperature sensor 26 and the humidity sensor 27 as the sensor means for collecting information which affect the electro-photography process, it is of course possible to use other or additional sensors and detectors.

According to the embodiments described above, it is possible to obtain the following effects, thereby making it possible to always obtain images having a high quality, on a short time basis and on a long term basis, when the potential estimation apparatus is applied to the image forming apparatus employing the electrophotography process.

First, it is possible to obtain the surface potential of the photosensitive drum (or body) with a high accuracy. In other words, since the charge retentivity and the exposure sensitivity of the photosensitive drum are monitored and used to estimate the charged potential and the exposed portion potential of the next print, it is possible to carry out a finer control which takes into consideration the changes in the charge retentivity and the exposure sensitivity when compared to the conventional case where the charge retentivity and the exposure sensitivity were estimated from the number of prints made and the running time of the image forming apparatus.

Second, it is possible to carry out a highly accurate control which takes into consideration the characteristic of the photosensitive drum by use of the neural network which has the learning function, without the need to carry out an extremely large number of experiments. Hence, the time required to develop the potential estimation apparatus and the cost of the potential estimation apparatus can both be reduced effectively. In other words, it is possible to realize the desired functions by a combination of a small number of parameters related to the environmental factors, the charger voltage and/or charging grid voltage, the exposing laser diode or lamp voltage and the photosensitive drum. If the same functions were to be realize using the method of looking up the table, the accuracy of the control would be determined by the size of the table, that is, the number of experiments conducted. Hence, according to the method of looking up the table, it would require an extremely large number of experiments to be conducted in order to carry out a highly accurate control, and the time required to develop the potential estimation apparatus and the cost of the potential estimation apparatus would both increase.

Third, it is possible to carry out a control to maintain a high image quality by detecting both the deterioration of the sensitivity of the photosensitive drum on the long term basis and the deterioration of the sensitivity of the photosensitive drum on the short term basis. The change in the potential characteristic of the photosensitive drum may occur on the long term basis due to the change in the film thickness caused by separation of the film at the time of the cleaning or the like, and on the short term basis due to the charge fatigue, exposure fatigue and the like caused by the repetition of the charging, exposure and discharging. According to the conventional case where various causes of the deteriorations in the sensitivity such as the number of prints made and the rotation time of the photosensitive drum, it was possible to detect the deterioration of the potential characteristic that occurs on the long term basis, but impossible to detect the deterioration of the potential characteristic which occurs on the short term basis. But according to the described embodiments, the charge retentivity and the exposure sensitivity for the next print are estimated based on the changes in the charge and exposure sensitivitys of the photosensitive drum, and thus, it is possible to detect both the change in the potential characteristic which occurs on the long term basis and the change in the potential characteristic which occurs on the short term basis.

Various kinds or neuron units and neural networks formed thereby may be used for each of the neural networks described above. For example, the neuron units and the neural networks are further disclosed in U.S. Pat. No. 5,131,073, U.S. Pat. No. 5,191,637, U.S. Pat. No. 5,185,851 and U.S. Pat. No. 5,167,006, the disclosures of which are hereby incorporated by reference.

Further, the present invention is not limited to these embodiments, but various variations and modifications may be made without departing from the scope of the present invention.

What is claimed is:

1. A potential estimation apparatus which estimates a potential of a photosensitive body of an image forming apparatus that carries out an electrophotography process using the photosensitive body, said potential estimation apparatus comprising:

a sensor group, including at least one sensor, sensing and outputting data related to information which affects the electrophotography process;

a storage unit storing the data output from said sensor group and information related to charge of the photosensitive body; and an estimation network including a first neural network which is coupled to said sensor group and said storage unit, estimating a charged portion potential of the photosensitive body based on a charge retentivity of the photosensitive body learned by said first neural network, said first neural network in a learning mode receiving as inputs at least one of the data output from said sensor group and time-sequentially sampled and parameters which affect the charge retentivity of the photosensitive body, and receiving as a teaching value a previously estimated charged portion potential with respect to at least an amount of charge and the charge retentivity of the photosensitive body.

2. The potential estimation apparatus as claimed in claim 1, wherein the charged portion potential is estimated from a relationship between the amount of charge and a charged portion potential within a past predetermined time.

3. The potential estimation apparatus as claimed in claim 1, wherein said information related to charge of the photosensitive body includes an amount of charge and an amount of exposure of the photosensitive body, and wherein said first neural network in the learning mode receives as the teaching value a previously estimated charged portion potential with respect to the amount of charge, the charge retentively and the amount of exposure of the photosensitive body.

4. The potential estimation apparatus as claimed in claim 3, wherein:

said estimation network further includes a second neural network, coupled to said sensor group and said storage unit, estimating an exposed portion potential of an exposed portion of the photosensitive body based on an exposure sensitivity of the photosensitive body learned by said second neural network;

said second neural network in a learning mode receiving as inputs at least one of the data output from said sensor group and time-sequentially sampled and parameters which affect the exposure sensitivity of the photosensitive body, and an output of said first neural network, and receiving as a teaching value a previously estimated exposed portion potential with respect to at least the exposure sensitivity, the amount of charge, an amount of exposure and the charged portion potential of the photosensitive body.

5. The potential estimation apparatus as claimed in claim 1, wherein:

said information related to charge of the photosensitive body includes an amount of charge and an amount of exposure of the photosensitive body, said estimation network further includes a second neural network, coupled to said sensor group and said storage unit, estimating an exposed portion potential of an exposed portion of the photosensitive body, said exposed portion potential being based on an exposure sensitivity of the photosensitive body learned by said second neural network, and said second neural network in a learning mode receiving as inputs at least one of the data output from said sensor group and time-sequentially sampled and parameters which affect the exposure sensitivity of the photosensitivity body, and an output of said first neural network, and receiving as a teaching value a previously estimated exposed portion potential with respect to at least the exposure sensitivity, the amount of charge, an amount of exposure and the charged portion potential of the photosensitive body.

6. A potential estimation apparatus which estimates a potential of a photosensitive body of an image forming apparatus that carries out an electrophotography process using the photosensitive body, said potential estimation apparatus comprising:

a sensor group including at least one sensor, sensing and outputting data related to information which affects the electrophotography process;

a storage unit storing the data output from said sensor group; and an estimation network, including a first neural network coupled to said sensor group and said storage unit, estimating a charged portion potential of the photosensitive body based on a charge retentivity of the photosensitive body learned by said first neural network, said first neural network in a learning mode receiving as inputs at least one of the data output from said sensor group and time-sequentially sampled and parameters which affect the charge retentivity of the photosensitive body, and receiving as a teaching value a previously estimated charged portion potential with respect to the estimated charged portion potential and an amount of charge of a pattern which is formed on the photosensitive body by charging with a predetermined amount of charge.

7. The potential estimation apparatus as claimed in claim 6, wherein the charged portion potential is estimated from a relationship between the amount of charge and a charged portion potential within a past predetermined time.

8. The potential estimation apparatus as claimed in claim 6, wherein:

said first neural network receives as a teaching value a previously estimated charged portion potential with respect to the estimated charged portion potential, the amount of charge and an amount of exposure of a pattern which is formed on the photosensitive body by charging with a predetermined amount of charge and exposing with a predetermined amount of exposure.

9. The potential estimating apparatus as claimed in claim 8, wherein:

said estimation network further includes a second neural network, coupled to said sensor group and said storage unit, estimating an exposed portion potential of an exposed portion of the photosensitive body based on an exposure sensitivity of the photosensitive body learned by said second neural network, said second neural network in a learning mode receiving as inputs at least one of the data output from said sensor group and time-sequentially sampled and parameters which affect the exposure sensitivity of the photosensitive body, and an output of said first neural network, and receiving as a teaching value a previously estimated exposed portion potential with respect to the estimated exposed portion potential, the estimated charged portion potential the amount of charge and the amount of exposure of a pattern which is form on the photosensitive body by charging with the predetermined amount of charge and exposing with a predetermined amount of exposure.

10. The potential estimation apparatus as claimed in claim 6, wherein:

said estimation network further includes a second neural network, coupled to said sensor group and said storage unit, estimating an exposed portion potential of an exposed portion of the photosensitive body based on an exposure sensitivity of the body learned by said second neural network, said second neural network in a learning mode receiving as inputs at least one of the data output from said sensor group and time-sequentially sampled and parameters which affect the exposure sensitivity of the photosensitive body, and an output of said first neural network, and receiving as a teaching value a previously estimated exposed portion potential with respect to the estimated exposed portion potential, the estimated charged portion potential, the amount of charge and the amount of exposure of a pattern which is formed on the photosensitive body by exposing with a predetermined amount of exposure.

11. A potential estimation apparatus which estimates a potential of a photosensitive body of an image forming apparatus that carries out an electrophotography process using the photosensitive body, said potential estimation apparatus comprising:

a sensor group, including at least one sensor, sensing and outputting data related information which affects the electrophotography process;

a storage unit storing the data output from said sensor group and information related to an amount of charge and an amount of exposure of the photosensitive body; and an estimating network, including a neural network coupled to said sensor group and said storage unit, estimating an exposed portion potential of an exposed portion of the photosensitive body based on an exposed sensitivity of the photosensitive body learned by said neural network, said neural network in a learning mode receiving as inputs at least one of the data output from said sensor group and time-sequentially sampled and parameters which affect the exposure sensitivity of the photosensitive body, and receiving as a teaching value a previously estimated exposed portion potential with respect to at least the exposure sensitivity, the amount of charge and the amount of exposure of the photosensitive body.

12. The potential estimation apparatus as claimed in claim 11, wherein the exposed portion potential is estimated from a relationship between the amount of exposure and an exposed portion potential within a past predetermined time.

13. A potential estimation apparatus which estimates a potential of a photosensitive body of an image forming apparatus that carries out an electrophotography process using the photosensitive body, said potential estimation apparatus comprising:

a sensor group, including at least one sensor, sensing and outputting data related to information which affects the electrophotography process;

a storage unit storing the data output from said sensor group; and an estimation network, including a neural network coupled to said sensor group and said storage unit, estimating an exposed portion potential of an exposed portion of the photosensitive body based on an exposure sensitivity of the photosensitive body learned by said neural network, said neural network in a learning mode receiving as inputs at least one of the data output from said sensor group and time-sequentially sampled and parameters which affect the exposure sensitivity of the photosensitive body, and receiving as a teaching value a previously estimated exposed portion potential with respect to at least the estimated exposed portion potential, an amount of charge and an amount of exposure of a pattern which is formed on the photosensitive body by charging with a predetermined amount of charge and exposing with a predetermined amount of exposure.

14. The potential estimation apparatus as claimed in claim 13, wherein the exposed portion potential is estimated from a relationship between the amount of exposure and an exposed portion potential within a past predetermined time.

15. A potential estimation apparatus which estimates a potential of a photosensitive body of an image forming apparatus that carries out an electrophotography process using the photosensitive body, said potential estimation apparatus comprising:

a sensor group, including at least on sensor, sensing and outputting data related to information which affects the electrophotography process;

a storage unit storing the data output from said sensor group and information related to an amount of charge and an amount of exposure of the photosensitive body; and an estimation network, including a neural network coupled to said sensor group and said storage unit, estimating a potential of a latent image portion of the photosensitive body based on a charge retentivity and an exposure sensitivity of the photosensitive body learned by said neural network, said neural network in a learning mode receiving as inputs at least one of the data output from said sensor group and time-sequentially sampled and parameters which affect the charge retentivity and the exposure sensitivity of the photosensitive body, and receiving as a teaching value a previously estimated latent image potential with respect to at least the charge retentivity, the exposure sensitivity, the amount of charge, the amount of exposure and the charged portion potential of the photosensitive body.

16. The potential estimation apparatus as claimed in claim 15, wherein the exposed portion potential is estimated from a relationship between the amount of exposure and an exposed portion potential within a past predetermined time.

17. A potential estimation apparatus which estimates a potential of the photosensitive body of an image forming apparatus that carries out an electrophotography process using the photosensitive body, said potential estimation apparatus comprising:

a sensor group, including at least one sensor, sensing and outputting data related to information which affects the electrophotography process;

a storage unit storing the data output from said sensor group; and an estimation network, including a neural network coupled to said sensor group and said storage unit, estimating a potential of a latent image portion of the photosensitive body based on a charge retentivity and an exposure sensitivity of the photosensitive body learned by said neural network, said neural network in a learning mode receiving as inputs at least one of the data output from said sensor group and time-sequentially sampled and parameters which affect the charge retentivity and the exposure sensitivity of the photosensitive body, and receiving as a teaching value a previously estimated latent image potential with respect to at least a charged portion potential, an exposed portion potential, an amount of charge and an amount of exposure of a pattern which is formed on the photosensitive body by charging with a predetermined amount of charge and exposing with a predetermined amount of exposure.

18. The potential estimation apparatus as claimed in claim 17, wherein the potential of a latent image portion is estimated from a relationship between the amount of charge, a latent image potential and the amount of exposure.

19. A potential estimation method for estimating a potential of a photosensitive body of an image forming apparatus that carries out an electrophotography process using the photosensitive body, said potential estimation method comprising the steps of:

(a) sensing and outputting output data related to information which affects the electrophotography process;

(b) storing the output data; and (c) estimating a charged portion potential of the photosensitive body based on a charge retentivity of the photosensitive body learned by a first neural network, said first neural network in a learning mode receiving as inputs at least one of the output data and time-sequentially sampled and parameters which affect the charge retentivity of the photosensitive body, and receiving as a teaching value a previously estimated charged portion potential with respect to at least an amount of charge and the charge retentivity of the photosensitive body.

20. The potential estimation method as claimed in claim 19, wherein said estimating step comprises estimating the charged portion potential from a relationship between the amount of charge and a charged portion potential within a past predetermined time.

21. The potential estimation method as claimed in claim 19, wherein said sensing and outputting step comprises sensing an amount of charge and an amount of exposure of the photosensitive body, and wherein said first neural network in the learning mode receives as the teaching value a previously estimated charged portion potential with respect to the amount of charge, the charge retentivity and the amount of exposure of the photosensitive body.

22. The potential estimation method as claimed in claim 21, which further comprises the steps of:

(d) estimating an exposed portion potential of an exposed portion of the photosensitive body based on an exposure sensitivity of the photosensitive body learned by a second neural network, said second neural network in a learning mode receiving as inputs at least one of the output data and time-sequentially sampled and parameters which affect the exposure sensitivity of the photosensitive body, and an output of said first neural network, and receiving as a teaching value a previously estimated exposed portion potential with respect to at least the exposure sensitivity, the amount of charge, an amount of exposure and the charged portion potential of the photosensitive body.

23. The potential estimation method as claimed in claim 19, wherein:

said information related to charge of the photosensitive body includes an amount of charge and an amount of exposure of the photosensitive body, said potential estimation method further comprising the steps of:

(d) estimating an exposed portion potential of an exposed portion of the photosensitive body by a second neural network, said exposed portion potential being based on an exposure sensitivity of the photosensitive body learned by said second neural network, said second neural network in a learning mode receiving as inputs at least one of the output data and time-sequentially sampled and parameters which affect the exposure sensitivity of the photosensitive body, and an output of said first neural network, and receiving as a teaching value a previously estimated exposed portion potential with respect to at least the exposure sensitivity, the amount of charge, an amount of exposure and the charged portion potential of the photosensitive body.

24. A potential estimation method for estimating a potential of a photosensitive body of an image forming apparatus that carries out an electrophotography process using the photosensitive body, said potential estimation method comprising the steps of:

(a) sensing and outputting output data related to information which affects the electrophotography process;

(b) storing the output data; and (c) estimating a charged portion potential of the photosensitive body based on a charge retentivity of the photosensitive body learned by a first neural network, said first neural network in a learning mode receiving as inputs at least one of the output data and time-sequentially sampled and parameters which affect the charge retentivity of the photosensitive body, and receiving as a teaching value a previously estimated charged portion potential with respect to the estimated charged portion potential and an amount of charge of a pattern which is formed on the photosensitive body by charging with a predetermined amount of charge.

25. The potential estimation method as claimed in claim 24 wherein said estimating step comprises estimating the charged portion potential from a relationship between the amount of charge and a charged portion potential within a past predetermined time.

26. The potential estimation method as claimed in claim 24, wherein:

said first neural network receives as a teaching value a previously estimated charged portion potential with respect to the estimated charged portion potential, the amount of charge and an amount of exposure of a pattern which is formed on the photosensitive body by charging with a predetermined amount of charge and exposing with a predetermined amount of exposure.

27. The potential estimation method as claimed in claim 26, which further comprises the steps of:

(d) estimating an exposed portion potential of an exposed portion of the photosensitive body based on an exposure sensitivity of the photosensitive body earned by a second neural network, said second neural network in a learning mode receiving as inputs at least one of the output data and time-sequentially sampled and parameters which affect the exposure sensitivity of the photosensitive body, and an output of said first neural network, and receiving as a teaching value a previously estimated exposed portion potential with respect to the estimated exposed portion potential, the estimated charged portion potential, the amount of charge and the amount of exposure of a pattern which is formed on the photosensitive body by charging with the predetermined amount of charge and exposing with a predetermined amount of exposure.

28. The potential estimation method as claimed in claim 24, which further comprises the steps of:

(d) estimating an exposed portion potential of an exposed portion of the photosensitive body based on an exposure sensitivity of the photosensitive body learned by a second neural network, said second neural network in a learning mode receiving as inputs at least one of the output data and time-sequentially sampled and parameters which affect the exposure sensitivity of the photosensitivity body, and an output of said first neural network, and receiving as a teaching value a previously estimated exposed portion potential with respect to the estimated exposed portion potential, the estimated charges portion potential, the amount of charge and the amount of exposure of a pattern which is formed on the photosensitive body by exposing with a predetermined amount of exposure.

29. A potential estimation method for estimating a potential of the photosensitive body of an image forming apparatus that carries out an electrophotography process using the photosensitive body, said potential estimation method comprising the steps of:

(a) sensing and outputting output data related to information which affects the electrophotography process;

(b) storing the output data related to information which related to an amount of charge and an amount of exposure of the photosensitive body; and (c) estimating an exposed potion potential of an exposed potion of the photosensitive body based on an exposure sensitivity of the photosensitive body learned by a neural network, said neural network in a learning mode receiving as inputs at least one of the output data and time-sequentially sampled and parameters which affect the exposure sensitivity of the photosensitive body, and receiving as a teaching value a previously estimated exposed portion potential with respect to at least the exposure sensitivity, the amount of charge and the amount of exposure of the photosensitive body.

30. The potential estimation method as claimed n claim 29, wherein said estimating step comprises estimating the exposed portion potential from a relationship between the amount of exposure and an exposed portion potential within a past predetermined time.

31. A potential estimation method for estimating a potential of a photosensitive body of an image forming apparatus that carries out an electrophotography process using the photosensitive body, said potential estimation method comprising the steps of:

(a) sensing and outputting output data related to information which affects the electrophotography process;

(b) storing the output data; and (c) estimating an exposed portion potential of an exposed portion of the photosensitive body based on an exposure sensitivity of the photosensitive body learned by a neural network, said neural network in a learning mode receiving as inputs at least one of the output data and time-sequentially sampled and parameters which affect the exposure sensitivity of the photosensitive body, and receiving as a teaching value a previously estimated portion potential with respect to at least the estimated exposed portion potential, an amount of charge and an amount of exposure of a pattern which is formed on the photosensitive body by charging with predetermined amount of charge and exposing with a predetermined amount of exposure.

32. The potential estimating method as claimed in claim 31, wherein said estimating step comprises estimating the exposed portion potential from a relationship between the amount of exposure and an exposed portion potential within a past predetermined time.

33. A potential estimation method for estimating a potential of a photosensitive body of an image forming apparatus that carries out an electrophotography process using the photosensitive body, said potential estimation method comprising the steps of:

(a) sensing and outputting output data related to information which affects the electrophotography process;

(b) storing the output data and information related to an amount of charge and an amount of exposure of the photosensitive body; and (c) estimating a potential of a latent image portion of the photosensitive body based on a charge retentivity and an exposure sensitivity of the photosensitive body learned by a neural network, said neural network in a learning mode receiving as inputs at least one of the output data and time-sequentially sampled and parameters which affect the charge retentivity and the exposure sensitivity of the photosensitive body, and receiving as a teaching value a previously estimated latent image potential with respect to at least the charge retentivity, the exposure sensitivity, the amount of charge, the amount of exposure and the charged portion potential of the photosensitive body.

34. The potential estimation method as claimed in claim 33, wherein said estimating step comprises estimating the potential of the latent image portion from a relationship between the amount of charge, a charge portion potential and the amount of exposure within a past predetermined time.

35. A potential estimation method for estimating a potential of a photosensitive body of an image forming apparatus that carries out an electrophotography process using the photosensitive body, said potential estimation method comprising the steps of:

(a) sensing and outputting output data related to information which affects the electrophotography process;

(b) storing the output data; and (c) estimating a potential of latent image portion of the photosensitive body based on a charge retentivity and an exposure sensitivity of the photosensitive body learned by a neural network, said neural network in a learning mode receiving as inputs at least one of the output data and time-sequentially sampled and parameters which affect the charge retentivity and the exposure sensitivity of the body, and receiving as a teaching value a previously estimated latent image potential with respect to at least a charged portion potential, an exposed portion potential, an amount of charge and an amount of exposure of a pattern which is formed on the photosensitive body by charging with a predetermined amount of charge and exposing with a predetermined amount of exposure.

36. The potential estimation method as claimed in claim 35, wherein said estimating step comprises estimating the potential of the latent image portion from a relationship between the amount of charge, a latent image potential and the amount of exposure.

* * * * *